US009447995B2

(12) United States Patent
Bloedow et al.

(10) Patent No.: US 9,447,995 B2
(45) Date of Patent: Sep. 20, 2016

(54) TEMPERATURE-STABILIZED STORAGE SYSTEMS WITH INTEGRAL REGULATED COOLING

(71) Applicant: Tokitae LLC, Bellevue, WA (US)

(72) Inventors: Jonathan Bloedow, Lynnwood, WA (US); Ryan Calderon, Seattle, WA (US); Michael Friend, Seattle, WA (US); David Gasperino, Lake Forest Park, WA (US); William Gates, Medina, WA (US); Roderick A. Hyde, Redmond, WA (US); Edward K. Y. Jung, Bellevue, WA (US); Shieng Liu, Bellevue, WA (US); Nathan P. Myhrvold, Medina, WA (US); Nathan John Pegram, Seattle, WA (US); David Keith Piech, Seattle, WA (US); Shannon Weise Stone, Redmond, WA (US); Clarence T. Tegreene, Mercer Island, WA (US); Charles Whitmer, North Bend, WA (US); Lowell L. Wood, Jr., Bellevue, WA (US); Ozgur Emek Yildirim, Bellevue, WA (US)

(73) Assignee: Tokitac LLC, Bellevue, WA (US)

( * ) Notice: Subject to any disclaimer, the term of this patent is extended or adjusted under 35 U.S.C. 154(b) by 348 days.

(21) Appl. No.: 14/098,886

(22) Filed: Dec. 6, 2013

(65) Prior Publication Data

US 2014/0150464 A1 Jun. 5, 2014

Related U.S. Application Data

(63) Continuation-in-part of application No. 13/906,909, filed on May 31, 2013, and a continuation-in-part of application No. 12/658,579, filed on Feb. 8, 2010.

(51) Int. Cl.
*F25B 21/02* (2006.01)
*F25B 21/04* (2006.01)
(Continued)

(52) U.S. Cl.
CPC ..... *F25B 21/04* (2013.01); *B65D 81/38* (2013.01); *F25B 21/02* (2013.01); *F25B 29/00* (2013.01); *F25D 3/005* (2013.01)

(58) Field of Classification Search
CPC ..... F25B 21/02; F25D 2400/12; F25D 2331/804; F25D 3/08; H01L 23/467; H01L 23/427
USPC ..... 62/3.2, 3.3, 3.62, 3.7, 371, 457.2; 165/104.21, 104.27, 104.33
See application file for complete search history.

(56) References Cited

U.S. PATENT DOCUMENTS 520,584 A 5/1894 Turner
1,903,171 A 3/1933 Cordrey
(Continued)

FOREIGN PATENT DOCUMENTS

CN 2414742 Y 1/2001
CN 2460457 Y 11/2001
(Continued)

OTHER PUBLICATIONS

Chinese State Intellectual Property Office, Office Action; App. No. 201180016103.1 (based on PCT Patent Application No. PCT/US2011/000234); Jun. 23, 2014 (received by our Agent on Jun. 25, 2014); pp. 1-23.
(Continued)

*Primary Examiner* — Melvin Jones

(57) ABSTRACT

In some embodiments, a regulated thermal transfer device for a storage container includes: a phase change material unit, the phase change material unit including one or more walls surrounding a phase-change material region, and an aperture in the one or more walls; a heat pipe with a first end positioned within the phase change material unit, and a second end; a thermoelectric unit thermally connected to the second end of the heat pipe; a heat sink connected to the thermoelectric unit, and positioned to radiate heat away from the thermoelectric unit; and an electronic controller operably connected to the thermoelectric unit; wherein the regulated thermal transfer device is of a size and shape to be positioned so that the phase change material unit is within a storage region of a temperature-stabilized storage container, and the thermoelectric unit is positioned adjacent to an external surface of the temperature-stabilized storage container.

43 Claims, 15 Drawing Sheets

(51) Int. Cl.

| | |
|---|---|
| ***B65D 81/38*** | (2006.01) |
| ***F25B 29/00*** | (2006.01) |
| ***F25D 3/00*** | (2006.01) |

(56) References Cited

U.S. PATENT DOCUMENTS 2,161,295 A 6/1939 Hirschberg
2,496,296 A 2/1950 Lobl
2,717,937 A 9/1955 Lehr et al.
2,967,152 A 1/1961 Matsch et al.
3,029,967 A 4/1962 Morrison
3,034,845 A 5/1962 Haumann
3,069,045 A 12/1962 Haumann et al.
3,108,840 A 10/1963 Conrad et al.
3,238,002 A 3/1966 O'Connell et al.
3,921,844 A 11/1975 Walles
3,948,411 A 4/1976 Conte
4,003,426 A 1/1977 Best et al.
4,034,129 A 7/1977 Kittle
4,057,029 A 11/1977 Seiter
4,057,101 A 11/1977 Ruka et al.
4,094,127 A 6/1978 Romagnoli
4,154,363 A 5/1979 Barthel
4,184,601 A 1/1980 Stewart et al.
4,312,669 A 1/1982 Boffito et al.
4,318,058 A 3/1982 Mito et al.
4,358,490 A 11/1982 Nagai
4,388,051 A 6/1983 Dresler et al.
4,402,927 A 9/1983 Von Dardel et al.
4,428,854 A 1/1984 Enjo et al.
4,481,779 A 11/1984 Barthel
4,481,792 A 11/1984 Groeger et al.
4,482,465 A 11/1984 Gray
4,521,800 A 6/1985 Howe
4,526,015 A 7/1985 Laskaris
4,640,574 A 2/1987 Unger
4,726,974 A 2/1988 Nowobilski et al.
4,766,471 A 8/1988 Ovshinsky et al.
4,796,432 A 1/1989 Fixsen et al.
4,810,403 A 3/1989 Bivens et al.
4,855,950 A 8/1989 Takada
4,862,674 A 9/1989 Lejondahl et al.
4,920,387 A 4/1990 Takasu et al.
4,951,014 A 8/1990 Wohlert et al.
4,955,204 A 9/1990 Pehl et al.
4,956,976 A 9/1990 Kral et al.
4,969,336 A 11/1990 Knippscheer et al.
4,974,423 A 12/1990 Pring
4,976,308 A 12/1990 Faghri
5,012,102 A 4/1991 Gowlett
5,103,337 A 4/1992 Schrenk et al.
5,116,105 A 5/1992 Hong
5,138,559 A 8/1992 Kuehl et al.
5,187,116 A 2/1993 Kitagawa et al.
5,215,214 A 6/1993 Lev et al.
5,245,869 A 9/1993 Clarke et al.
5,261,241 A 11/1993 Kitahara et al.
5,277,031 A 1/1994 Miller et al.
5,277,959 A 1/1994 Kourtides et al.
5,302,840 A 4/1994 Takikawa
5,330,816 A 7/1994 Rusek, Jr.
5,355,684 A 10/1994 Guice
5,359,890 A 11/1994 Fulton et al.
5,376,184 A 12/1994 Aspden
5,390,734 A 2/1995 Voorhes et al.
5,390,791 A 2/1995 Yeager
5,444,223 A 8/1995 Blama
5,452,565 A 9/1995 Blom et al.
5,505,046 A 4/1996 Nelson et al.
5,548,116 A 8/1996 Pandelisev
5,563,182 A 10/1996 Epstein et al.
5,573,133 A 11/1996 Park
5,579,830 A * 12/1996 Giammaruti ..... F28D 15/02 165/104.21
5,580,522 A 12/1996 Leonard et al.
5,590,054 A 12/1996 McIntosh
5,600,071 A 2/1997 Sooriakumar et al.
5,607,076 A 3/1997 Anthony
5,633,077 A 5/1997 Olinger
5,671,856 A 9/1997 Lisch
5,679,412 A 10/1997 Kuehnle et al.
5,709,472 A 1/1998 Prusik et al.
5,782,344 A 7/1998 Edwards et al.
5,800,905 A 9/1998 Sheridan et al.
5,821,762 A 10/1998 Hamaguchi et al.
5,829,594 A 11/1998 Warder
5,831,489 A 11/1998 Wire
5,846,224 A 12/1998 Sword et al.
5,846,883 A 12/1998 Moslehi
5,857,778 A 1/1999 Ells
5,900,554 A 5/1999 Baba et al.
5,915,283 A 6/1999 Reed et al.
5,954,101 A 9/1999 Drube et al.
6,030,580 A 2/2000 Raasch et al.
6,042,264 A 3/2000 Prusik et al.
6,050,598 A 4/2000 Upton
6,209,343 B1 4/2001 Owen
6,212,904 B1 4/2001 Arkharov et al.
6,213,339 B1 4/2001 Lee
6,234,341 B1 5/2001 Tattam
6,260,613 B1 * 7/2001 Pollard, II ..... F28D 15/02 165/104.21
6,272,679 B1 8/2001 Norin
6,287,652 B2 9/2001 Speckhals et al.
6,321,977 B1 11/2001 Lee
6,337,052 B1 1/2002 Rosenwasser
6,438,992 B1 8/2002 Smith et al.
6,439,406 B1 8/2002 Duhon
6,453,749 B1 9/2002 Petrovic et al.
6,465,366 B1 10/2002 Nemani et al.
6,467,642 B2 10/2002 Mullens et al.
6,485,805 B1 11/2002 Smith et al.
6,521,077 B1 2/2003 McGivern et al.
6,571,971 B1 6/2003 Weiler
6,584,797 B1 7/2003 Smith et al.
6,624,349 B1 9/2003 Bass
6,673,594 B1 1/2004 Owen et al.
6,688,132 B2 2/2004 Smith et al.
6,692,695 B1 2/2004 Bronshtein et al.
6,701,724 B2 3/2004 Smith et al.
6,742,650 B2 6/2004 Yang et al.
6,742,673 B2 6/2004 Credle, Jr. et al.
6,751,963 B2 6/2004 Navedo et al.
6,771,183 B2 8/2004 Hunter
6,806,808 B1 10/2004 Watters et al.
6,808,011 B2 * 10/2004 Lindemuth ..... F25B 23/006 165/104.26
6,813,330 B1 11/2004 Barker et al.
6,841,917 B2 1/2005 Potter
6,877,504 B2 4/2005 Schreff et al.
6,967,051 B1 11/2005 Augustynowicz et al.
6,997,241 B2 2/2006 Chou et al.
7,001,656 B2 2/2006 Maignan et al.
7,038,585 B2 5/2006 Hall et al.
7,128,807 B2 10/2006 Mörschner et al.
7,240,513 B1 7/2007 Conforti
7,253,788 B2 8/2007 Choi et al.
7,258,247 B2 8/2007 Marquez
7,267,795 B2 9/2007 Ammann et al.
7,278,278 B2 10/2007 Wowk et al.
7,596,957 B2 10/2009 Fuhr et al.
7,789,258 B1 9/2010 Anderson
7,807,242 B2 10/2010 Soerensen et al.
7,982,673 B2 7/2011 Orton et al.
8,074,271 B2 12/2011 Davis et al.
8,138,913 B2 3/2012 Nagel et al.
8,174,369 B2 5/2012 Jones et al.
8,211,516 B2 7/2012 Bowers et al.
2002/0050514 A1 5/2002 Schein
2002/0083717 A1 7/2002 Mullens et al.
2002/0084235 A1 7/2002 Lake
2002/0130131 A1 9/2002 Zucker et al.
2002/0155699 A1 10/2002 Ueda

(56) References Cited

U.S. PATENT DOCUMENTS

| | | | |
|---|---|---|---|
| 2002/0187618 | A1 | 12/2002 | Potter |
| 2003/0039446 | A1 | 2/2003 | Hutchinson et al. |
| 2003/0072687 | A1 | 4/2003 | Nehring et al. |
| 2003/0148773 | A1 | 8/2003 | Spriestersbach et al. |
| 2003/0160059 | A1 | 8/2003 | Credle, Jr. et al. |
| 2004/0035120 | A1 | 2/2004 | Brunnhofer |
| 2004/0055313 | A1 | 3/2004 | Navedo et al. |
| 2004/0055600 | A1 | 3/2004 | Izuchukwu |
| 2004/0103302 | A1 | 5/2004 | Yoshimura et al. |
| 2004/0113790 | A1 | 6/2004 | Hamel et al. |
| 2004/0145533 | A1 | 7/2004 | Taubman |
| 2005/0009192 | A1 | 1/2005 | Page |
| 2005/0029149 | A1 | 2/2005 | Leung et al. |
| 2005/0053345 | A1 | 3/2005 | Bayindir et al. |
| 2005/0067441 | A1 | 3/2005 | Alley |
| 2005/0143787 | A1 | 6/2005 | Boveja et al. |
| 2005/0188715 | A1 | 9/2005 | Aragon |
| 2005/0247312 | A1 | 11/2005 | Davies |
| 2005/0255261 | A1 | 11/2005 | Nomula |
| 2005/0274378 | A1 | 12/2005 | Bonney et al. |
| 2006/0021355 | A1 | 2/2006 | Boesel et al. |
| 2006/0027467 | A1 | 2/2006 | Ferguson |
| 2006/0054305 | A1 | 3/2006 | Ye |
| 2006/0071585 | A1 | 4/2006 | Wang |
| 2006/0086808 | A1 | 4/2006 | Appalucci et al. |
| 2006/0150662 | A1 | 7/2006 | Lee et al. |
| 2006/0187026 | A1 | 8/2006 | Kochis |
| 2006/0191282 | A1 | 8/2006 | Sekiya et al. |
| 2006/0196876 | A1 | 9/2006 | Rohwer |
| 2006/0220987 | A1 | 10/2006 | Atchiriki |
| 2006/0259188 | A1 | 11/2006 | Berg |
| 2006/0280007 | A1 | 12/2006 | Ito et al. |
| 2007/0041814 | A1 | 2/2007 | Lowe |
| 2007/0046559 | A1 | 3/2007 | Youn |
| 2007/0210090 | A1 | 9/2007 | Sixt et al. |
| 2008/0012577 | A1 | 1/2008 | Potyrailo et al. |
| 2008/0022698 | A1 | 1/2008 | Hobbs et al. |
| 2008/0060215 | A1 | 3/2008 | Reilly et al. |
| 2008/0129511 | A1 | 6/2008 | Yuen et al. |
| 2008/0164265 | A1 | 7/2008 | Conforti |
| 2008/0184719 | A1 | 8/2008 | Lowenstein |
| 2008/0186139 | A1 | 8/2008 | Butler et al. |
| 2008/0231453 | A1 | 9/2008 | Corder |
| 2008/0233391 | A1 | 9/2008 | Sterzel et al. |
| 2008/0269676 | A1 | 10/2008 | Bieberich et al. |
| 2008/0272131 | A1 | 11/2008 | Roberts et al. |
| 2008/0297346 | A1 | 12/2008 | Brackmann et al. |
| 2009/0049845 | A1 | 2/2009 | McStravick et al. |
| 2009/0275478 | A1 | 11/2009 | Atkins et al. |
| 2009/0301125 | A1 | 12/2009 | Myles et al. |
| 2009/0309733 | A1 | 12/2009 | Moran et al. |
| 2010/0016168 | A1 | 1/2010 | Atkins et al. |
| 2010/0028214 | A1 | 2/2010 | Howard et al. |
| 2010/0265068 | A1 | 10/2010 | Brackmann et al. |
| 2010/0287963 | A1 | 11/2010 | Billen et al. |
| 2011/0100605 | A1 | 5/2011 | Zheng et al. |
| 2011/0117538 | A1 | 5/2011 | Niazi |
| 2011/0248825 | A1 | 10/2011 | Hamel et al. |
| 2011/0297306 | A1 | 12/2011 | Yang |
| 2012/0168645 | A1 | 7/2012 | Atzmony et al. |
| 2013/0306656 | A1 | 11/2013 | Eckhoff et al. |

FOREIGN PATENT DOCUMENTS

| | | | |
|---|---|---|---|
| CN | 1496537 | A | 5/2004 |
| CN | 1756912 | A | 4/2006 |
| CN | 1827486 | A | 9/2006 |
| CN | 101073524 | A | 11/2007 |
| FR | 2 621 685 | | 10/1987 |
| GB | 2 441 636 | A | 3/2008 |
| WO | WO 94/15034 | | 7/1994 |
| WO | WO 99/36725 | A1 | 7/1999 |
| WO | WO 2005/084353 | A2 | 9/2005 |
| WO | WO 2007/039553 | A2 | 4/2007 |

OTHER PUBLICATIONS

"About Heat Leak—Comparison"; Technifab Products, Inc.; printed on Jun. 25, 2014; 2 pages; located at www.technifab.com/cryogenic-resource-library/about-heat-leak.html.

PCT International Search Report; International App. No. PCT/US2014/067863; Mar. 27, 2015; pp. 1-3.

U.S. Appl. No. 14/070,892, Hyde et al.

U.S. Appl. No. 14/070,234, Hyde et al.

U.S. Appl. No. 13/907,470, Bowers et al.

U.S. Appl. No. 13/906,909, Bloedow et al.

U.S. Appl. No. 13/853,245, Eckhoff et al.

U.S. Appl. No. 13/720,328, Hyde et al.

U.S. Appl. No. 13/720,256, Hyde et al.

U.S. Appl. No. 13/489,058, Bowers et al.

U.S. Appl. No. 13/385,088, Hyde et al.

U.S. Appl. No. 13/374,218, Hyde et al.

U.S. Appl. No. 13/200,555, Chou et al.

U.S. Appl. No. 13/199,439, Hyde et al.

U.S. Appl. No. 13/135,126, Deane et al.

U.S. Appl. No. 12/927,982, Deane et al.

U.S. Appl. No. 12/927,981, Chou et al.

U.S. Appl. No. 12/658,579, Deane et al.

U.S. Appl. No. 12/220,439, Hyde et al.

U.S. Appl. No. 12/152,467, Bowers et al.

U.S. Appl. No. 12/152,465, Bowers et al.

U.S. Appl. No. 12/077,322, Hyde et al.

U.S. Appl. No. 12/012,490, Hyde et al.

U.S. Appl. No. 12/008,695, Hyde et al.

U.S. Appl. No. 12/006,089, Hyde et al.

U.S. Appl. No. 12/006,088, Hyde et al.

U.S. Appl. No. 12/001,757, Hyde et al.

3M Monitor Mark™; "Time Temperature Indicators—Providing a visual history of time temperature exposure"; 3M Microbiology; bearing a date of 2006; pp. 1-4; located at 3M.com/microbiology.

Abdul-Wahab et al.; "Design and experimental investigation of portable solar thermoelectric refrigerator"; Renewable Energy; 2009; pp. 30-34; vol. 34; Elsevier Ltd.

Adams, R. O.; "A review of the stainless steel surface"; The Journal of Vacuum Science and Technology A; Bearing a date of Jan.-Mar. 1983; pp. 12-18; vol. 1, No. 1; American Vacuum Society.

Arora, Anubhav; Hakim, Itzhak; Baxter, Joy; Rathnasingham, Ruben; Srinivasan, Ravi; Fletcher, Daniel A.; "Needle-Free Delivery of Macromolecules Across the Skin by Nanoliter-Volume Pulsed Microjets"; PNAS Applied Biological Sciences; Mar. 13, 2007; pp. 4255-4260; vol. 104; No. 11; The National Academy of Sciences USA.

Astrain et al.; "Computational model for refrigerators based on Peltier effect application"; Applied Thermal Engineering; 2005; pp. 3149-3162; vol. 25; Elsevier Ltd.

Azzouz et al.; "Improving the energy efficiency of a vapor compression system using a phase change material"; Second Conference on Phase Change Material & Slurry: Scientific Conference & Business Forum; Jun. 15-17, 2005; pp. 1-11; Yverdon-les-Bains, Switzerland.

Bang, Abhay T.; Bang, Rani A.; Baitule, Sanjay B.; Reddy, M. Hanimi; Deshmukh, Mahesh D.; "Effect of Home-Based Neonatal Care and Management of Sepsis on Neonatal Mortality: Field Trial in Rural India"; The Lancet; Dec. 4, 1999; pp. 1955-1961; vol. 354; SEARCH (Society for Education, Action, and Research in Community Health).

Bapat, S. L. et al.; "Experimental investigations of multilayer insulation"; *Cryogenics;* Bearing a date of Aug. 1990; pp. 711-719; vol. 30.

Bapat, S. L. et al.; "Performance prediction of multilayer insulation"; *Cryogenics;* Bearing a date of Aug. 1990; pp. 700-710; vol. 30.

Barth, W. et al.; "Experimental investigations of superinsulation models equipped with carbon paper"; *Cryogenics;* Bearing a date of May 1988; pp. 317-320; vol. 28.

(56) References Cited

OTHER PUBLICATIONS

Barth, W. et al.; "Test results for a high quality industrial superinsulation"; *Cryogenics;* Bearing a date of Sep. 1988; pp. 607-609; vol. 28.
Bartl, J., et al.; "Emissivity of aluminium and its importance for radiometric measurement"; Measurement Science Review; Bearing a date of 2004; pp. 31-36; vol. 4, Section 3.
Beavis, L. C.; "Interaction of Hydrogen with the Surface of Type 304 Stainless Steel"; The Journal of Vacuum Science and Technology; Bearing a date of Mar.-Apr. 1973; pp. 386-390; vol. 10, No. 2; American Vacuum Society.
Benvenuti, C.; "Decreasing surface outgassing by thin film getter coatings"; *Vacuum;* Bearing a date of 1998; pp. 57-63; vol. 50; No. 1-2; Elsevier Science Ltd.
Benvenuti, C.; "Nonevaporable getter films for ultrahigh vacuum applications"; *Journal of Vacuum Science Technology A Vacuum Surfaces, and Films;* Bearing a date of Jan./Feb. 1998; pp. 148-154; vol. 16; No. 1; American Chemical Society.
Benvenuti, C. et al.; "Obtention of pressures in the $10^{-14}$ torr range by means of a Zr V Fe non evaporable getter"; *Vacuum;* Bearing a date of 1993; pp. 511-513; vol. 44; No. 5-7; Pergamon Press Ltd.
Benvenuti, C., et al.; "Pumping characteristics of the St707 nonevaporable getter (Zr 70 V 24.6—Fe 5.4 wt %)"; The Journal of Vacuum Science and Technology A; Bearing a date of Nov.-Dec. 1996; pp. 3278-3282; vol. 14, No. 6; American Vacuum Society.
Berman, A.; "Water vapor in vacuum systems"; *Vacuum;* Bearing a date of 1996; pp. 327-332; vol. 47; No. 4; Elsevier Science Ltd.
Bernardini, M. et al.; "Air bake-out to reduce hydrogen outgassing from stainless steel"; *Journal of Vacuum Science Technology;* Bearing a date of Jan./Feb. 1998; pp. 188-193; vol. 16; No. 1; American Chemical Society.
Bine Informationsdienst; "Zeolite/water refrigerators, Projektinfo 16/10"; BINE Information Service; printed on Feb. 12, 2013; pp. 1-4; FIZ Karlsruhe, Germany; located at: http://www.bine.info/fileadmin/content/Publikationen/Englische_Infos/projekt_1610_engl_internetx.pdf.
Bo, H. et al.; "Tetradecane and hexadecane binary mixtures as phase change materials (PCMs) for cool storage in district cooling systems"; *Energy;* Bearing a date of 1999; vol. 24; pp. 1015-1028; Elsevier Science Ltd.
Boffito, C. et al.; "A nonevaporable low temperature activatable getter material"; *Journal of Vacuum Science Technology;* Bearing a date of Apr. 1981; pp. 1117-1120; vol. 18; No. 3; American Vacuum Society.
Brenzel, Logan; Wolfson, Lara J.; Fox-Rushby, Julia; Miller, Mark; Halsey, Neal A.; "Vaccine-Preventable Diseases—Chapter 20"; Disease Control Priorities in Developing Countries; printed on Oct. 15, 2007; pp. 389-411.
Brown, R.D.; "Outgassing of epoxy resins in vacumm."; *Vacuum;* Bearing a date of 1967; pp. 25-28; vol. 17; No. 9; Pergamon Press Ltd.
Burns, H. D.; "Outgassing Test for Non-metallic Materials Associated with Sensitive Optical Surfaces in a Space Environment"; MSFC-SPEC-1443; Bearing a date of Oct. 1987; pp. 1-10.
Cabeza, L. F. et al.; "Heat transfer enhancement in water when used as PCM in thermal energy storage"; Applied Thermal Engineering; 2002; pp. 1141-1151; vol. 22; Elsevier Science Ltd.
CDC; "Vaccine Management: Recommendations for Storage and Handling of Selected Biologicals"; Jan. 2007; 16 pages total; Department of Health & Human Services U.S.A.
Chatterjee et al.; "Thermoelectric cold-chain chests for storing/transporting vaccines in remote regions"; Applied Energy; 2003; pp. 415-433; vol. 76; Elsevier Ltd.
Chen, Dexiang et al.; "Characterization of the freeze sensitivity of a hepatitis B vaccine"; Human Vaccines; Jan. 2009; pp. 26-32; vol. 5, Issue 1; Landes Bioscience.
Chen, Dexiang, et al.; "Opportunities and challenges of developing thermostable vaccines"; Expert Reviews Vaccines; 2009; pp. 547-557; vol. 8, No. 5; Expert Reviews Ltd.
Chen, G. et al.; "Performance of multilayer insulation with slotted shield"; *Cryogenics ICEC Supplement;* Bearing a date of 1994; pp. 381-384; vol. 34.
Chen, J. R.; "A comparison of outgassing rate of 304 stainless steel and A6063-EX aluminum alloy vacuum chamber after filling with water"; *Journal of Vacuum Science Technology A Vacuum Surfaces and Film;* Bearing a date of Mar. 1987; pp. 262-264; vol. 5; No. 2; American Chemical Society.
Chen, J. R. et al.; "An aluminum vacuum chamber for the bending magnet of the SRRC synchrotron light source"; *Vacuum;* Bearing a date of 1990; pp. 2079-2081; vol. 41; No. 7-9; Pergamon Press PLC.
Chen, J. R. et al.; "Outgassing behavior of A6063-EX aluminum alloy and SUS 304 stainless steel"; *Journal of Vacuum Science Technology;* Bearing a date of Nov./Dec. 1987; pp. 3422-3424; vol. 5; No. 6; American Vacuum Society.
Chen, J. R. et al.; "Outgassing behavior on aluminum surfaces: Water in vacuum systems"; *Journal of Vacuum Science Technology;* Bearing a date of Jul./Aug. 1994; pp. 1750-1754; vol. 12; No. 4; American Vacuum Society.
Chen, J. R. et al.; "Thermal outgassing from aluminum alloy vacuum chambers"; *Journal of Vacuum Science Technology;* Bearing a date of Nov./Dec. 1985; pp. 2188-2191; vol. 3; No. 6; American Vacuum Society.
Chiggiato, P.; "Production of extreme high vacuum with non evaporable getters" *Physica Scripta;* Bearing a date of 1997; pp. 9-13; vol. T71.
Chinese State Intellectual Property Office; Office Action; App. No. 200980109399.4; Aug. 29, 2012; pp. 1-12 (No translation provided).
Chinese State Intellectual Property Office; Office Action; App. No. 200880120367.X; Oct. 25, 2012; pp. 1-5 (No translation provided).
Chinese State Intellectual Property Office; Office Action; App. No. 200880120366.5; Jun. 27, 2013; 3 pages (No English translation available).
Chinese State Intellectual Property Office; Office Action; App. No. 200880120366.5; Feb. 17, 2013 (received by our agent Feb. 19, 2013); pp. 1-3 (No translation provided).
Chinese State Intellectual Property Office; Office Action; App. No. 200880120366.5; Jun. 1, 2012; pp. 1-19 (No translation provided).
Chinese State Intellectual Property Office, Office Action; App. No. 200880119918.0; Sep. 18, 2013 (rec'd by our agent Sep. 20, 2013); pp. 1-10 (No English translation available).
Chinese State Intellectual Property Office; Office Action; App. No. 200880119918.0; May 27, 2013 (received by our agent on May 29, 2013); 9 pages (No English Translation Available).
Chinese State Intellectual Property Office; Office Action; App. No. 200880119918.0; Dec. 12, 2012; pp. 1-11 (No translation provided).
Chinese State Intellectual Property Office; Office Action; App. No. 200880119918.0; Jul. 13, 2011; pp. 1-9 (No translation provided).
Chinese State Intellectual Property Office; Office Action; App. No. 200880119777.2; Jan. 7, 2013 (received by our agent on Jan. 9, 2013); pp. 1-12 (No translation provided).
Chinese State Intellectual Property Office; Office Action; App. No. 200880119777.2; Mar. 30, 2012; pp. 1-10 (No translation provided).
Chiritescu, Catalin; Cahill, David G.; Nguyen, Ngoc; Johnson, David; Bodapati, Arun; Keblinski, Pawel; Zschack, Paul; "Ultralow Thermal Conductivity in Disordered, Layered WSe2 Crystals; Science"; Jan. 19, 2007; pp. 351-353; vol. 315; The American Association for the Advancement Science.
Chiu et al.; "Submerged finned heat exchanger latent heat storage design and its experimental verification"; Applied Energy; 2012; pp. 507-516; vol. 93; Elsevier Ltd.
Cho, B.; "Creation of extreme high vacuum with a turbomolecular pumping system: A baking approach"; *Journal of Vacuum Science Technology;* Bearing a date of Jul./Aug. 1995; pp. 2228-2232; vol. 13; No. 4; American Vacuum Society.
Choi, S. et al.; "Gas permeability of various graphite/epoxy composite laminates for cryogenic storage systems"; *Composites Part B: Engineering;* Bearing a date of 2008; pp. 782-791; vol. 39; Elsevier Science Ltd.

(56) References Cited

OTHER PUBLICATIONS

Chun, I. et al.; "Effect of the Cr-rich oxide surface on fast pumpdown to ultrahigh vacuum"; *Journal of Vacuum Science Technology A Vacuum, Surfaces, and Films;* Bearing a date of Sep./Oct. 1997; pp. 2518-2520; vol. 15; No. 5; American Vacuum Society.

Chun, I. et al.; "Outgassing rate characteristic of a stainless-steel extreme high vacuum system"; *Journal of Vacuum Science Technology;* Bearing a date of Jul./Aug. 1996; pp. 2636-2640; vol. 14; No. 4; American Vacuum Society.

Cohen, Sharon; Hayes, Janice S. Tordella, Tracey; Puente, Ivan; "Thermal Efficiency of Prewarmed Cotton, Reflective, and Forced—Warm-Air Inflatable Blankets in Trauma Patients"; International Journal of Trauma Nursing; Jan.-Mar. 2002; pp. 4-8; vol. 8; No. 1; The Emergency Nurses Association.

Cole-Parmer; "Temperature Labels and Crayons"; www.coleparmer.com; bearing a date of 1971 and printed on Sep. 27, 2007; p. 1.

Conde-Petit, Manuel R.; "Aqueous solutions of lithium and calcium chlorides:—Property formulations for use in air conditioning equipment design"; 2009; pp. 1-27 plus two cover pages; M. Conde Engineering, Zurich, Switzerland.

Conway et al.; "Improving Cold Chain Technologies through the Use of Phase Change Material"; Thesis, University of Maryland; 2012; pp. ii-xv and 16-228.

Cool-System KEG GMBH; "Cool-System presents: CoolKeg® The world's first self-chilling Keg!"; printed on Feb. 6, 2013; pp. 1-5; located at: http://www.coolsystem.de/.

Cornell University Coop; "The Food Keeper"; printed on Oct. 15, 2007; 7 pages total (un-numbered).

Crawley, D J. et al.; "Degassing Characteristics of Some 'O' Ring Materials"; *Vacuum;* Bearing a date of 1963; pp. 7-9; vol. 14; Pergamon Press Ltd.

Csernatony, L.; "The Properties of Viton 'A' Elastomers II. The influence of permeation, diffusion and solubility of gases on the gas emission rate from an O-ring used as an atmospheric seal or high vacuum immersed"; *Vacuum;* Bearing a date of 1965; pp. 129-134; vol. 16; No. 3; Pergamon Press Ltd.

Dai et al.; "Experimental investigation and analysis on a thermoelectric refrigerator driven by solar cells"; Solar Energy Materials & Solar Cells; 2003; pp. 377-391; vol. 77; Elsevier Science B.V.

Daryabeigi, Kamran; "Thermal Analysis and Design Optimization of Multilayer Insulation for Reentry Aerodynamic Heating"; Journal of Spacecraft and Rockets; Jul.-Aug. 2002; pp. 509-514; vol. 39; No. 4; American Institute of Aeronautics and Astronautics Inc.

Dawoud, et al.; "Experimental study on the kinetics of water vapor sorption on selective water sorbents, silica gel and alumina under typical operating conditions of sorption heat pumps"; International Journal of Heat and Mass Transfer; 2003; pp. 273-281; vol. 46; Elsevier Science Ltd.

Day, C.; "The use of active carbons as cryosorbent"; *Colloids and Surfaces A Physicochemical and Engineering Aspects;* Bearing a date of 2001; pp. 187-206; vol. 187-188; Elsevier Science.

Della Porta, P.; "Gas problem and gettering in sealed-off vacuum devices"; *Vacuum;* Bearing a date of 1996; pp. 771-777; vol. 47; No. 6-8 Elsevier Science Ltd.

Demko, J. A., et al.; "Design Tool for Cryogenic Thermal Insulation Systems"; Advances in Cryogenic Engineering: Transactions of the Cryogenic Engineering Conference—CEC; Bearing a date of 2008; pp. 145-151; vol. 53; American Institute of Physics.

Department of Health and Social Services, Division of Public Health, Section of Community Health and EMS, State of Alaska; Cold Injuries Guidelines—Alaska Multi-Level 2003 Version; bearing dates of 2003 and Jan. 2005; pp. 1-60; located at http://www.chems.alaska.gov.

Dometic S.A.R.L.; "Introduction of Zeolite Technology into refrigeration systems, LIFE04 ENV/LU/000829, Layman's Report"; printed on Feb. 6, 2013; pp. 1-10; located at: http://ec.europa.eu/environment/life/project/Projects/index.cfm?fuseaction=home.showFile&rep=file&fil=LIFE04_ENV_LU_000829_LAYMAN.pdf.

Dow Chemical Company; "Calcium Chloride Handbook: A Guide to Properties, Forms, Storage and Handling"; Aug. 2003; pp. 1-28.

Dylla, H. F. et al.; "Correlation of outgassing of stainless steel and aluminum with various surface treatments"; *Journal of Vacuum Science Technology;* Bearing a date of Sep./Oct. 1993; pp. 2623-2636; vol. 11; No. 5; American Vacuum Society.

Edstam, James S. et al.; "Exposure of hepatitis B vaccine to freezing temperatures during transport to rural health centers in Mongolia"; Preventive Medicine; 2004; pp. 384-388; vol. 39; The Institute for Cancer Prevention and Elsevier Inc.

Efe, Emine et al.; "What do midwives in one region in Turkey know about cold chain?"; Midwifery; 2008; pp. 328-334; vol. 24; Elsevier Ltd.

Elsey, R. J. "Outgassing of vacuum material I"; *Vacuum;* Bearing a date of 1975; pp. 299-306; vol. 25; No. 7; Pergamon Press Ltd.

Elsey, R. J. "Outgassing of vacuum materials II" *Vacuum;* Bearing a date of 1975; pp. 347-361; vol. 25; No. 8; Pergamon Press Ltd.

Engelmann, G. et al.; "Vacuum chambers in composite material"; *Journal of Vacuum Science Technology;* Bearing a date of Jul./Aug. 1987; pp. 2337-2341; vol. 5; No. 4; American Vacuum Society.

Ette, Ene I.; "Conscience, the Law, and Donation of Expired Drugs"; The Annals of Pharmacotherapy; Jul./Aug. 2004; pp. 1310-1313; vol. 38.

Eyssa, Y. M. et al.; "Thermodynamic optimization of thermal radiation shields for a cryogenic apparatus"; *Cryogenics;* Bearing a date of May 1978; pp. 305-307; vol. 18; IPC Business Press.

Ferrotec; "Ferrofluid: Magnetic Liquid Technology"; bearing dates of 2001-2008; printed on Mar. 10, 2008; found at http://www.ferrotec.com/technology/ferrofluid.php.

Fricke, Jochen; Emmerling, Andreas; "Aerogels—Preparation, Properties, Applications"; Structure and Bonding; 1992; pp. 37-87; vol. 77; Springer-Verlag Berlin Heidelberg.

Gast Manufacturing, Inc.; "Vacuum and Pressure Systems Handbook"; printed on Jan. 3, 2013; pp. 1-20; located at: http://www.gastmfg.com/vphb/vphb_sl.pdf.

Gea Wiegand; "Pressure loss in vacuum lines with water vapour"; printed on Mar. 13, 2013; pp. 1-2; located at http://produkte.gea-wiegand.de/GEA/GEACategory/139/index_en.html.

Ghoshal et al.; "Efficient Switched Thermoelectric Refrigerators for Cold Storage Applications"; Journal of Electronic Materials; 2009; pp. 1-6; doi: 10.1007/s11664-009-0725-3.

Glassford, A. P. M. et al.; "Outgassing rate of multilayer insulation"; 1978; Bearing a date of 1978; pp. 83-106.

Greenbox Systems; "Thermal Management System"; 2010; Printed on: Feb. 3, 2011; p. 1 of 1; located at http://www.greenboxsystems.com.

Groulx et al.; "Solid-Liquid Phase Change Simulation Applied to a Cylindrical Latent Heat Energy Storage System"; Excerpt from the Proceedings of the COMSOL Conference, Boston; 2009; pp. 1-7.

Günter, M. M. et al.; "Microstructure and bulk reactivity of the nonevaporable getter Zr57V36Fe7", J. Vac. Sci. Technol. A; Nov./Dec. 1998; pp. 3526-3535; vol. 16, No. 6; American Vacuum Society.

Gupta, A. K. et al.; "Outgassing from epoxy resins and methods for its reduction"; *Vacuum;* Bearing a date of 1977; pp. 61-63; vol. 27; No. 12; Pergamon Press Ltd.

Hałaczek, T. et al.; "Flat-plate cryostat for measurements of multilayer insulation thermal conductivity"; *Cryogenics;* Bearing a date of Oct. 1985; pp. 593-595; vol. 25; Butterworth & Co. Ltd.

Hałaczek, T. et al.; "Unguarded cryostat for thermal conductivity measurements of multilayer insulations"; *Cryogenics;* Bearing a date of Sep. 1985; pp. 529-530; vol. 25; Butterworth & Co. Ltd.

Hałaczek, T. L. et al.; "Heat transport in self-pumping multilayer insulation"; *Cryogenics;* Bearing a date of Jun. 1986; pp. 373-376; vol. 26; Butterworth & Co. Ltd.

(56) References Cited

OTHER PUBLICATIONS

Halaczek, T. L. et al.; "Temperature variation of thermal conductivity of self-pumping multilayer insulation"; *Cryogenics;* Bearing a date of Oct. 1986; pp. 544-546.; vol. 26; Butterworth & Co. Ltd.
Hall, Larry D.; "Building Your Own Larry Hall Icyball"; printed on Mar. 27, 2013; pp. 1-4; located at: http://crosleyautoclub.com/IcyBall/HomeBuilt/HallPlans/IB_Directions.html.
Halldórsson, Árni, et al.; "The sustainable agenda and energy efficiency: Logistics solutions and supply chains in times of climate change"; *International Journal of Physical Distribution & Logistics Management;* Bearing a date of 2010; pp. 5-13; vol. 40; No. ½; Emerald Group Publishing Ltd.
Halliday, B. S.; "An introduction to materials for use in vacuum"; *Vacuum;* Bearing a date of 1987; pp. 583-585; vol. 37; No. 8-9; Pergamon Journals Ltd.
Hedayat, A., et al.; "Variable Density Multilayer Insulation for Cryogenic Storage"; Contract NAS8-40836; 36$^{th}$ Joint Propulsion Conference; Bearing a date of Jul. 17-19, 2000; pp. 1-10.
Hipgrave, David B. et al ; "Immunogenicity of a Locally Produced Hepatitis B Vaccine With the Birth Dose Stored Outside the Cold Chain in Rural Vietnam"; Am. J. Trop. Med. Hyg.; 2006; pp. 255-260; vol. 74, No. 2; The American Society of Tropical Medicine and Hygiene.
Hipgrave, David B. et al.; "Improving birth dose coverage of hepatitis B vaccine"; Bulletin of the World Health Organization; Jan. 2006; pp. 65-71; vol. 84, No. 1; World Health Organization.
Hirohata, Y.; "Hydrogen desorption behavior of aluminium materials used for extremely high vacuum chamber"; *Journal of Vacuum Science Technology;* Bearing a date of Sep./Oct. 1993; pp. 2637-2641; vol. 11; No. 5; American Vacuum Society.
Hobson, J. P. et al.; "Pumping of methane by St707 at low temperatures"; J. Vac. Sci. Technol. A; May/Jun. 1986; pp. 300-302; vol. 4, No. 3; American Vacuum Society.
Holtrop, K. L. et al.; "High temperature outgassing tests on materials used in the DIII-D tokamak"; *Journal of Vacuum Science Technology;* Bearing a date of Jul./Aug. 2006; pp. 1572- ; vol. 24; No. 4; American Vacuum Society.
Hong, S. et al.; "Investigation of gas species in a stainless steel ultrahigh vacuum chamber with hot cathode ionization gauges"; *Measurement Science and Technology;* Bearing a date of 2004; pp. 359-364; vol. 15; IOP Science.
Horgan, A. M., et al.; "Hydrogen and Nitrogen Desorption Phenomena Associated with a Stainless Steel 304 Low Energy Electron Diffraction (LEED) and Molecular Beam Assembly"; The Journal of Vacuum Science and Technology; Bearing a date of Jul.-Aug. 1972; pp. 1218-1226; vol. 9, No. 4.
Ishikawa, Y.; "An overview of methods to suppress hydrogen outgassing rate from austenitic stainless steel with reference to UHV and EXV"; *Vacuum;* Bearing a date of 2003; pp. 501-512; vol. 69; No. 4; Elsevier Science Ltd.
Ishikawa, Y. et al.; "Reduction of outgassing from stainless surfaces by surface oxidation"; *Vacuum;* Bearing a date of 1990; pp. 1995-1997; vol. 4; No. 7-9; Pergamon Press PLC.
Ishimaru, H.; "All-aluminum-alloy ultrahigh vacuum system for a large-scale electron-positron collider"; *Journal of Vacuum Science Technology;* Bearing a date of Jun. 1984; pp. 1170-1175; vol. 2; No. 2; American Vacuum Society.
Ishimaru, H.; "Aluminium alloy-sapphire sealed window for ultra-high vacuum"; *Vacuum;* Bearing a date of 1983; pp. 339-340.; vol. 33; No. 6; Pergamon Press Ltd.
Ishimaru, H.; "Bakeable aluminium vacuum chamber and bellows with an aluminium flange and metal seal for ultra-high vacuum"; *Journal of Vacuum Science Technology;* Bearing a date of Nov./Dec. 1978; pp. 1853-1854; vol. 15; No. 6; American Vacuum Society.
Ishimaru, H.; "Ultimate pressure of the order of $10^{-13}$ Torr in an aluminum alloy vacuum chamber"; *Journal of Vacuum Science and Technology;* Bearing a date of May/Jun. 1989; pp. 2439-2442; vol. 7; No. 3; American Vacuum Society.
Ishimaru, H. et al.; "All Aluminum Alloy Vacuum System for the TRISTAN e+ e− Storage"; *IEEE Transactions on Nuclear Science;* Bearing a date of Jun. 1981; pp. 3320-3322; vol. NS-28; No. 3.
Ishimaru, H. et al.; "Fast pump-down aluminum ultrahigh vacuum system"; *Journal of Vacuum Science Technology;* Bearing a date of May/Jun. 1992; pp. 547-552 ; vol. 10; No. 3; American Vacuum Society.
Ishimaru, H. et al.; "Turbomolecular pump with an ultimate pressure of $10^{-12}$ Torr"; *Journal of Vacuum Science Technology;* Bearing a date of Jul./Aug. 1994; pp. 1695-1698; vol. 12; No. 4; American Vacuum Society.
Jacob, S. et al.; "Investigations into the thermal performance of multilayer insulation (300-77 K) Part 1: Calorimetric studies"; *Cryogenics;* Bearing a date of 1992; pp. 1137-1146; vol. 32; No. 12; Butterworth-Heinemann Ltd.
Jacob, S. et al.; "Investigations into the thermal performance of multilayer insulation (300-77 K) Part 2: Thermal analysis"; *Cryogenics;* Bearing a date of 1992; pp. 1147-1153; vol. 32; No. 12; Butterworth-Heinemann Ltd.
JAMC; "Preventing Cold Chain Failure: Vaccine Storage and Handling"; JAMC; Oct. 26, 2004; p. 1050; vol. 171; No. 9; Canadian Medical Association.
Jenkins, C. H. M.; "Gossamer spacecraft: membrane and inflatable structures technology for space applications"; AIAA; Bearing a date of 2000; pp. 503-527; vol. 191.
Jhung, K. H. C. et al.; "Achievement of extremely high vacuum using a cryopump and conflat aluminium"; *Vacuum;* Bearing a date of 1992; pp. 309-311; vol. 43; No. 4; Pergamon Press PLC.
Jiajitsawat, Somchai; "A Portable Direct-PV Thermoelectric Vaccine Refrigerator with Ice Storage Through Heat Pipes"; Dissertation, University of Massachusetts, Lowell; 2008; three cover pages, pp. ii-x, 1-137
Jorgensen, Pernille; Chanthap, Lon; Rebueno, Antero; Tsuyuoka, Reiko; Bell, David; "Malaria Rapid Diagnostic Tests in Tropical Climates: The Need for a Cool Chain"; American Journal of Tropical Medicine and Hygiene; 2006; pp. 750-754; vol. 74; No. 5; The American Society of Tropical Medicine and Hygiene.
Kato, S. et al.; "Achievement of extreme high vacuum in the order of $10^{-10}$ Pa without baking of test chamber"; *Journal of Vacuum Science Technology;* Bearing a date of May/Jun. 1990; pp. 2860-2864; vol. 8 ; No. 3; American Vacuum Society.
Keller, C. W., et al.; "Thermal Performance of Multilayer Insulations, Final Report, Contract NAS 3-14377"; Bearing a date of Apr. 5, 1974; pp. 1-446.
Keller, K. et al.; "Application of high temperature multilayer insulations"; *Acta Astronautica ;* Bearing a date of 1992; pp. 451-458; vol. 26; No. 6; Pergamon Press Ltd.
Kempers et al.; "Characterization of evaporator and condenser thermal resistances of a screen mesh wicked heat pipe"; International Journal of Heat and Mass Transfer; 2008; pp. 6039-6046; vol. 51; Elsevier Ltd.
Kendal, Alan P. et al.; "Validation of cold chain procedures suitable for distribution of vaccines by public health programs in the USA"; Vaccine; 1997; pp. 1459-1465; vol. 15, No. 12/13; Elsevier Science Ltd.
Khemis, O. et al.; "Experimental analysis of heat transfers in a cryogenic tank without lateral insulation"; Applied Thermal Engineering; 2003; pp. 2107-2117; vol. 23; Elsevier Ltd.
Kishiyama, K., et al.; "Measurement of Ultra Low Outgassing Rates for NLC UHV Vacuum Chambers"; Proceedings of the 2001 Particle Accelerator Conference, Chicago; Bearing a date of 2001; pp. 2195-2197; IEEE.
Kozubal, et al.; "Desiccant Enhanced Evaporative Air-Conditioning (DEVap): Evaluation of a New Concept in Ultra Efficient Air Conditioning, Technical Report NREL/TP-5500-49722"; National Renewable Energy Laboratory; Jan. 2011; pp. i-vii, 1-60, plus three cover pages and Report Documentation Page.
Koyatsu, Y. et al. "Measurements of outgassing rate from copper and copper alloy chambers"; *Vacuum;* Bearing a date of 1996; pp. 709-711; vol. 4; No. 6-8; Elsevier Science Ltd.
Kristensen, D. et al.; "Stabilization of vaccines: Lessons learned"; *Human Vaccines;* Bearing a date of Mar. 2010; pp. 227-231; vol. 6; No. 3; Landes Bioscience.

(56) References Cited

OTHER PUBLICATIONS

Kropschot, R. H.; "Multiple layer insulation for cryogenic applications"; *Cryogenics;* Bearing a date of Mar. 1961; pp. 135-135; vol. 1.
Levin, Carol E.; Nelson, Carib M.; Widjaya, Anton; Moniaga, Vanda; Anwar, Chairiyah; "The Costs of Home Delivery of a Birth Dose of Hepatitis B Vaccine in a Prefilled Syringe in Indonesia"; Bulletin of the World Health Organization; Jun. 2005; pp. 456-461 + 1 pg. Addenda; vol. 83; No. 6.
Li, Y.; "Design and pumping characteristics of a compact titanium—vanadium non-evaporable getter pump"; *Journal of Vacuum Science Technology;* Bearing a date of May/Jun. 1998; pp. 1139-1144; vol. 16; No. 3; American Vacuum Society.
Li, Yang et al.; "Study on effect of liquid level on the heat leak into vertical cryogenic vessels"; Cryogenics; 2010; pp. 367-372; vol. 50; Elsevier Ltd.
Little, Arthur D.; "Liquid Propellant Losses During Space Flight, Final Report on Contract No. NASw-615"; Bearing a date of Oct. 1964; pp. 1-315.
Liu, Y. C. et al.; "Thermal outgassing study on aluminum surfaces"; *Vacuum;* Bearing a date of 1993; pp. 435-437; vol. 44; No. 5-7; Pergamon Press Ltd.
Llanos-Cuentas, A.; Campos, P.; Clendenes, M.; Canfield. C.J.; Hutchinson, D.B.A.; "Atovaquone and Proguanil Hydrochloride Compared with Chloroquine or Pyrimethamine/Sulfadoxine for Treatment of Acute Plasmodium Falciparum Malaria in Peru"; The Brazilian Journal of Infectious Diseases; 2001; pp. 67-72; vol. 5; No. 2; The Brazilian Journal of Infectious Diseases and Contexto Publishing.
Lockheed Missiles & Space Company; "High-Performance Thermal Protection Systems, Contract NAS 8-20758, vol. II"; Bearing a date of Dec. 31, 1969; pp. 1-117.
Lockman, Shahin; Ndase, P.; Holland, D.; Shapiro, R.; Connor, J.; Capparelli, E.; "Stability of Didanosine and Stavudine Pediatric Oral Solutions and Kaletra Capsules at Temperatures from 4° C. to 55° C."; 12th Conference on Retroviruses and Opportunistic Infections, Boston, Massachusetts; Feb. 22-25, 2005; p. 1; Foundation for Retrovirology and Human Health.
Londer, H. et al.; "New high capacity getter for vacuum insulated mobile $LH_2$ storage tank systems"; *Vacuum;* Bearing a date of 2008; pp. 431-434; vol. 82; No. 4; Elsevier Ltd.
Ma, Kun-Quan; and Liu, Jing; "Nano liquid-metal fluid as ultimate coolant"; Physics Letters A; bearing dates of Jul. 10, 2006, Sep. 9, 2006, Sep. 18, 2006, Sep. 26, 2006, and Jan. 29, 2007; pp. 252-256; vol. 361, Issue 3; Elsevier B.V.
machine-history.com; "Refrigeration Machines"; printed on Mar. 27, 2013; pp. 1-10; located at: http://www.machine-history.com/Refrigeration%20Machines.
Magennis, Teri et al. "Pharmaceutical Cold Chain: A Gap in the Last Mile—Part 1. Wholesaler/Distributer: Missing Audit Assurance"; Pharmaceutical & Medical Packaging News; Sep. 2010; pp. 44, 46-48, and 50; pmpnews.com.
Marquardt, Niels; "Introduction to the Principles of Vacuum Physics"; 1999; pp. 1-24; located at: http://www.cientificosaficionados.com/libros/CERN/vacio1-CERN.pdf.
Matolin, V. et al.; "Static SIMS study of TiZrV NEG activation"; Vacuum; 2002; pp. 177-184; vol. 67; Elsevier Science Ltd.
Matsuda, A. et al.; "Simple structure insulating material properties for multilayer insulation"; *Cryogenics;* Bearing a date of Mar. 1980; pp. 135-138; vol. 20; IPC Business Press.
Matthias, Dipika M., et al.; "Freezing temperatures in the vaccine cold chain: A systematic literature review"; Vaccine; 2007; pp. 3980-3986; vol. 25; Elsevier Ltd.
Mikhalchenko, R. S. et al.; "Study of heat transfer in multilayer insulations based on composite spacer materials."; *Cryogenics;* Bearing a date of Jun. 1983; pp. 309-311; vol. 23; Butterworth & Co. Ltd.
Mikhalchenko, R. S. et al.; "Theoretical and experimental investigation of radiative-conductive heat transfer in multilayer insulation"; *Cryogenics;* Bearing a date of May 1985; pp. 275-278; vol. 25; Butterworth & Co. Ltd.
Miki, M. et al.; "Characteristics of extremely fast pump-down process in an aluminum ultrahigh vacuum system"; *Journal of Vacuum Science Technology;* Bearing a date of Jul./Aug. 1994; pp. 1760-1766; vol. 12; No. 4; American Vacuum Society.
Modern Mechanix; "Icyball Is Practical Refrigerator for Farm or Camp Use (Aug. 1930)"; bearing a date of Aug. 1930; printed on Mar. 27, 2013; pp. 1-3; located at: http://blog.modernmechanix.com/icyball-is-practical-refrigerator-for-farm-or-camp-use/.
Mohamad et al.; "An Analysis of Sensitivity Distribution Using Two Differential Excitation Potentials in ECT"; IEEE Fifth International Conference on Sensing Technology; 2011; pp. 575-580; IEEE.
Mohamad et al.; "A introduction of two differential excitation potentials technique in electrical capacitance tomography"; Sensors and Actuators A; 2012; pp. 1-10; vol. 180; Elsevier B.V.
Mohri, M. et al.; "Surface study of Type 6063 aluminium alloys for vacuum chamber materials"; *Vacuum;* Bearing a date of 1984; pp. 643-647; vol. 34; No. 6; Pergamon Press Ltd.
Moonasar, Devanand; Goga, Ameena Ebrahim; Frean, John; Kruger, Philip; Chandramohan; Daniel; "An Exploratory Study of Factors that Affect the Performance and Usage of Rapid Diagnostic Tests for Malaria in the Limpopo Province, South Africa"; Malaria Journal; Jun. 2007; pp. 1-5; vol. 6; No. 74; Moonasar et al.; licensee BioMed Central Ltd.
Moshfegh, B.; "A New Thermal Insulation System for Vaccine Distribution; Journal of Thermal Insulation"; Jan. 1992; pp. 226-247; vol. 15; Technomic Publishing Co., Inc.
Mughal et al.; "Review of Capacitive Atmospheric Icing Sensors"; The Sixth International Conference on Sensor Technologies and Applications (SENSORCOMM); 2012; pp. 42-47; IARIA.
Mukugi, K. et al.; "Characteristics of cold cathode gauges for outgassing measurements in uhv range"; *Vacuum;* Bearing a date of 1993; pp. 591-593; vol. 44; No. 5-7; Pergamon Press Ltd.
Nelson, Carib M. et al.; "Hepatitis B vaccine freezing in the Indonesian cold chain: evidence and solutions"; Bulletin of the World Health Organization; Feb. 2004; pp. 99-105 (plus copyright page); vol. 82, No. 2; World Health Organization.
Nemanič, V.; "Outgassing of thin wall stainless steel chamber"; *Vacuum;* Bearing a date of 1998; pp. 431-437; vol. 50; No. 3-4; Elsevier Science Ltd.
Nemanič, V.; "Vacuum insulating panel"; *Vacuum;* bearing a date of 1995; pp. 839-842; vol. 46; No. 8-10; Elsevier Science Ltd.
Nemanič, V.; "Anomalies in kinetics of hydrogen evolution from austenitic stainless steel from 300 to 1000° C."; *Journal of Vacuum Science Technology;* Bearing a date of Jan./Feb. 2001; pp. 215-222; vol. 19; No. 1; American Vacuum Society.
Nemanič, V.; "Outgassing in thin wall stainless steel cells"; *Journal of Vacuum Science Technology;* Bearing a date of May/Jun. 1999; pp. 1040-1046; vol. 17; No. 3; American Vacuum Society.
Nemanič, Vincenc, et al.; "A study of thermal treatment procedures to reduce hydrogen outgassing rate in thin wall stainless steel cells"; Vacuum; Bearing a date of 1999; pp. 277-280; vol. 53; Elsevier Science Ltd.
Nemanič, Vincenc, et al.; "Experiments with a thin-walled stainless-steel vacuum chamber"; The Journal of Vacuum Science and Technology A; Bearing a date of Jul.-Aug. 2000; pp. 1789-1793; vol. 18, No. 4; American Vacuum Society.
Nemanič, Vincenc, et al.; "Outgassing of a thin wall vacuum insulating panel"; Vacuum; Bearing a date of 1998; pp. 233-237; vol. 49, No. 3; Elesevier Science Ltd.
Nolan, Timothy D. C.; Hattler, Brack G.; Federspiel, William J.; "Development of a Balloon Volume Sensor for Pulsating Balloon Catheters"; ASAIO Journal; 2004; pp. 225-233; vol. 50; No. 3; American Society of Artificial Internal Organs.
NSM Archive; "Band structure and carrier concentration"; date of Jan. 22, 2004 provided by examiner, printed on Feb. 16, 2013; pp. 1-10, 1 additional page of archive information; located at: http://web.archive.org/20040122200811/http://ioffe.rssi.ru/SVA/NSM/Semicond/SiC/bandstr.html.

(56) References Cited

OTHER PUBLICATIONS

Odaka, K.; "Dependence of outgassing rate on surface oxide layer thickness in type 304 stainless steel before and after surface oxidation in air"; *Vacuum;* Bearing a date of 1996; pp. 689-692; vol. 47; No. 6-8; Elsevier Science Ltd.
Odaka, K. et al.; "Effect of baking temperature and air exposure on the outgassing rate of type 316L stainless steel"; *Journal of Vacuum Science Technology;* Bearing a date of Sep./Oct. 1987; pp. 2902-2906; vol. 5; No. 5; American Vacuum Society.
Okamura, S. et al.; "Outgassing measurement of finely polished stainless steel"; *Journal of Vacuum Science Technology;* Bearing a date of Jul./Aug. 1991; pp. 2405-2407; vol. 9; No. 4; American Vacuum Society.
Omer et al.; "Design optimization of thermoelectric devices for solar power generation"; Solar Energy Materials and Solar Cells; 1998; pp. 67-82; vol. 53; Elsevier Science B.V.
Omer et al.; "Experimental investigation of a thermoelectric refrigeration system employing a phase change material integrated with thermal diode (thermosyphons)"; Applied Thermal Engineering; 2001; pp. 1265-1271; vol. 21; Elsevier Science Ltd.
Oró et al.; "Review on phase change materials (PCMs) for cold thermal energy storage applications"; Applied Energy; 2012; pp. 1-21; doi: 10.1016/j.apenergy.2012.03.058; Elsevier Ltd.
Owusu, Kwadwo Poku; "Capacitive Probe for Ice Detection and Accretion Rate Measurement: Proof of Concept"; Master of Science Thesis, Department of Mechanical Engineering, University of Manitoba; 2010; pp. i-xi, 1-95.
OXYCHEM; "Calcium Chloride, A Guide to Physical Properties"; printed on Jan. 3, 2013; pp. 1-9, plus two cover pages and back page; Occidental Chemical Corporation; located at: http://www.cal-chlor.com/PDF/GUIDE-physical-properties.pdf.
PATH —A Catalyst for Global Health; "Uniject™ Device—The Radically Simple Uniject™ Device—Rethinking the Needle to Improve Immunization"; bearing dates of 1995-2006; printed on Oct. 11, 2007; pp. 1-2; located at http://www.path.org/projects/uniject.php; PATH Organization.
Patrick, T.J.; "Outgassing and the choice of materials for space instrumentation"; *Vacuum;* Bearing a date of 1973; pp. 411-413; vol. 23; No. 11; Pergamon Press Ltd.
Patrick, T.J.; "Space environment and vacuum properties of spacecraft materials"; *Vacuum;* Bearing a date of 1981; pp. 351-357; vol. 31; No. 8-9; Pergamon Press Ltd.
Pau, Alice K.; Moodley, Neelambal K.; Holland, Diane T.; Fomundam, Henry; Matchaba, Gugu U.; and Capparelli, Edmund V.; "Instability of lopinavir/ritonavir capsules at ambient temperatures in sub-Saharan Africa: relevance to WHO antiretroviral guidelines"; AIDS; Bearing dates of 2005, Mar. 29, 2005, and Apr. 20, 2005; pp. 1229-1236; vol. 19, No. 11; Lippincott Williams & Wilkins.
PCT International Search Report; Application No. PCT/US2011/001939; Mar. 27, 2012; pp. 1-2.
PCT International Search Report; International App. No. PCT/US11/00234; Jun. 9, 2011; pp. 1-4.
PCT International Search Report; International App. No. PCT/US09/01715; Jan. 8, 2010; pp. 1-2.
PCT International Search Report; International App. No. PCT/US08/13646; Apr. 9, 2009; pp. 1-2.
PCT International Search Report; International App. No. PCT/US08/13648; Mar. 13, 2009; pp. 1-2.
PCT International Search Report; International App. No. PCT/US08/13642; Feb. 26, 2009; pp. 1-2.
PCT International Search Report; International App. No. PCT/US08/13643; Feb. 20, 2009; pp. 1-2.
Pekala, R. W.; "Organic Aerogels From the Polycondensation of Resorcinol With Formaldehyde"; Journal of Materials Science; Sep. 1989; pp. 3221-3227; vol. 24; No. 9; Springer Netherlands.
Peng et al.; "Determination of the optimal axial length of the electrode in an electrical capacitance tomography sensor"; Flow Measurement and Instrumentation; 2005; pp. 169-175; vol. 16; Elsevier Ltd.
Peng et al.; "Evaluation of Effect of No. Of Electrodes in ECT Sensors on Image Quality"; IEEE Sensors Journal; May 2012; pp. 1554-1565; vol. 12, No. 5; IEEE.
Pickering, Larry K.; Wallace, Gregory; Rodewald, Lance; "Too Hot, Too Cold: Issues with Vaccine Storage"; Pediatrics®—Official Journal of the American Academy of Pediatrics; 2006; pp. 1738-1739 (4 pages total, incl. cover sheet and end page); vol. 118; American Academy of Pediatrics.
Poole, K. F. et al.; "Hialvac and Teflon outgassing under ultra-high vacuum conditions"; *Vacuum;* Bearing a date of Jun. 30, 1980; pp. 415-417; vol. 30; No. 10; Pergamon Press Ltd.
Post, Richard F.; "Maglev: A New Approach"; Scientific American; Jan. 2000; pp. 82-87; Scientific American, Inc.
Program for Appropriate Technology in Health (PATH); "The Radically Simple Uniject Device"; PATH—Reflections on Innovations in Global Health; printed on Jan. 26, 2007; pp. 1-4; located at www.path.org.
Pure Temp; "Technology"; Printed on: Feb. 9, 2011; p. 1-3; located at http://puretemp.com/technology.html.
Redhead, P. A.; "Recommended practices for measuring and reporting outgassing data"; *Journal of Vacuum Science Technology;* Bearing a date of Sep./Oct. 2002; pp. 1667-1675; vol. 20; No. 5; American Vacuum Society.
Reeler, Anne V.; Simonsen, Lone; Health Access International; "Unsafe Injections, Fatal Infections"; Bill and Melinda Gates Children's Vaccine Program Occasional Paper #2; May 2000; pp. 1-8; located at www.ChildrensVaccine.org/html/safe_injection.htm.
Ren, Qian et al.; "Evaluation of an Outside-The-Cold-Chain Vaccine Delivery Strategy in Remote Regions of Western China"; Public Health Reports; Sep.-Oct. 2009; pp. 745-750; vol. 124.
Restuccia, et al.; "Selective water sorbent for solid sorption chiller: experimental results and modeling"; International Journal of Refrigeration; 2004; pp. 284-293; vol. 27; Elsevier Ltd and IIR.
Rezk, et al.; "Physical and operating conditions effects on silica gel/water adsorption chiller performance"; Applied Energy; 2012; pp. 142-149; vol. 89; Elsevier Ltd.
Rietschle Thomas; "Calculating Pipe Size & Pressure Drops in Vacuum Systems, Section 9—Technical Reference"; printed on Jan. 3, 2013; pp. 9-5 through 9-7; located at: http://www.ejglobalinc.com/Tech.htm.
Riffat et al.; "A novel thermoelectric refrigeration system employing heat pipes and a phase change material: an experimental investigation"; Renewable Energy; 2001; pp. 313-323; vol. 23; Elsevier Science Ltd.
Risha, Peter G.; Shewiyo, Danstan; Msami, Amani; Masuki, Gerald; Vergote, Geert; Vergote, Chris; Remon, Jean Paul; "In vitro Evaluation of the Quality of Essential Drugs on the Tanzanian Market"; Tropical Medicine and International Health; Aug. 2002; pp. 701-707; vol. 7; No. 8; Blackwell Science Ltd.
Robak et al.; "Enhancement of latent heat energy storage using embedded heat pipes"; International Journal of Heat and Mass Transfer; 2011; pp. 3476-3483; vol. 54; Elsevier Ltd.
Rodríguez et al.; "Development and experimental validation of a computational model in order to simulate ice cube production in a thermoelectric ice maker"; Applied Thermal Engineering; 2009; one cover page and pp. 1-28; doi: 10.1016/j.applthermaleng.2009.03.005.
Rogers, Bonnie et al.; "Vaccine Cold Chain—Part 1. Proper Handling and Storage of Vaccine"; AAOHN Journal; 2010; pp. 337-344 (plus copyright page); vol. 58, No. 8; American Association of Occupational Health Nurses, Inc.
Rogers, Bonnie et al.; Vaccine Cold Chain—Part 2. Training Personnel and Program Management; AAOHN Journal; 2010; pp. 391-402 (plus copyright page); vol. 58, No. 9; American Association of Occupational Health Nurses, Inc.
Russel et al.; "Characterization of a thermoelectric cooler based thermal management system under different operating conditions"; Applied Thermal Engineering; 2012; two cover pages and pp. 1-29; doi: 10.1016/j.applthermaleng.2012.05.002.
Rutherford, S; "The Benefits of Viton Outgassing"; Bearing a date of 1997; pp. 1-5; Duniway Stockroom Corp.

(56) References Cited

OTHER PUBLICATIONS

SAES GETTERS; "St707 Getter Alloy for Vacuum Systems"; printed on Sep. 22, 2011; pp. 1-2; located at http://www.saegetters.com/default.aspx?idPage=212.
Saha, et al.; "A new generation of cooling device employing $CaCl_2$-in-silica gel-water system"; International Journal of Heat and Mass Transfer; 2009; pp. 516-524; vol. 52; Elsevier Ltd.
Saito, K. et al.; "Measurement system for low outgassing materials by switching between two pumping paths"; *Vacuum;* Bearing a date of 1996; pp. 749-752; vol. 47; No. 6-8; Elsevier Science Ltd.
Saitoh, M. et al.; "Influence of vacuum gauges on outgassing rate measurements" ; *Journal of Vacuum Science Technology;* Bearing a date of Sep./Oct. 1993; pp. 2816-2821; vol. 11; No. 5; American Vacuum Society.
Santhanam, S. M. T. J. et al. ;"Outgassing rate of reinforced epoxy and its control by different pretreatment methods"; *Vacuum;* Bearing a date of 1978; pp. 365-366; vol. 28; No. 8-9; Pergamon Press Ltd.
Sasaki, Y. T.; "Reducing SS 304/316 hydrogen outgassing to $2\times10^{-15}$torr l/cm $^2$s"; *Journal of Vacuum Science Technology;* Bearing a date of Jul./Aug. 2007; pp. 1309-1311; vol. 25; No. 4; American Vacuum Society.
Sasaki, Y. Tito; "A survey of vacuum material cleaning procedures: A subcommittee report of the American Vacuum Society Recommended Practices Committee"; The Journal of Vacuum Science and Technology A; Bearing a date of May-Jun. 1991; pp. 2025-2035; vol. 9, No. 3; American Vacuum Society.
Scurlock, R. G. et al.; "Development of multilayer insulations with thermal conductivities below 0.1 μW $cm^{-1}$ $K^{-1}$"; *Cryogenics;* Bearing a date of May 1976; pp. 303-311; vol. 16.
Setia, S. et al.; "Frequency and causes of vaccine wastage"; *Vaccine ;*Bearing a date of 2002; pp. 1148-1156; vol. 20; Elsevier Science Ltd.
Seto, Joyce; Marra, Fawziah; "Cold Chain Management of Vaccines"; Continuing Pharmacy Professional Development Home Study Program; Feb. 2005; pp. 1-19; University of British Columbia.
Sharifi et al.; "Heat pipe-assisted melting of a phase change material"; International Journal of Heat and Mass Transfer; 2012; pp. 3458-3469; vol. 55; Elsevier Ltd.
Shockwatch; "Environmental Indicators"; printed on Sep. 27, 2007; pp. 1-2; located at www.shockwatch.com.
Shu, Q. S. et al.; "Heat flux from 277 to 77 K through a few layers of multilayer insulation"; *Cryogenics;* Bearing a date of Dec. 1986; pp. 671-677; vol. 26; Butterworth & Co. Ltd.
Shu, Q. S. et al.; "Systematic study to reduce the effects of cracks in multilayer insulation Part 1: Theoretical model"; *Cryogenics;* Bearing a date of May 1987; pp. 249-256; vol. 27; Butterworth & Co. Ltd.
Shu, Q. S. et al.; "Systematic study to reduce the effects of cracks in multilayer insulation Part 2: experimental results"; *Cryogenics;* Bearing a date of Jun. 1987; pp. 298-311; vol. 27; No. 6; Butterworth & Co. Ltd.
Spur Industries Inc.; "The Only Way to Get Them Apart is to Melt Them Apart"; 2006; pp. 1-3; located at http://www.spurind.com/applications.php.
Stampa et al.; "Numerical Study of Ice Layer Growth Around a Vertical Tube"; Engenharia Térmica (Thermal Engineering); Oct. 2005; pp. 138-144; vol. 4, No. 2.
Suemitsu, M. et al.; "Development of extremely high vacuums with mirror-polished Al-alloy chambers"; *Vacuum;* Bearing a date of 1993; pp. 425-428; vol. 44; No. 5-7; Pergamon Press Ltd.
Suemitsu, M. et al.; "Ultrahigh-vacuum compatible mirror-polished aluminum-alloy surface: Observation of surface-roughness-correlated outgassing rates"; *Journal of Vacuum Science Technology;* Bearing a date of May/Jun. 1992; pp. 570-572; vol. 10; No. 3; American Vacuum Society.
Suttmeier, Chris; "Warm Mix Asphalt: A Cooler Alternative"; Material Matters—Around the Hot Mix Industry; Spring 2006; pp. 21-22; Peckham Materials Corporation.
Tatenuma, K. et al.; "Acquisition of clean ultrahigh vacuum using chemical treatment"; *Journal of Vacuum Science Technology;* Bearing a date of Jul./Aug. 1998; pp. 2693-2697; vol. 16; No. 4; American Vacuum Society.
Tatenuma, K.; "Quick acquisition of clean ultrahigh vacuum by chemical process technology"; *Journal of Vacuum Science Technology;* Bearing a date of Jul./Aug. 1993; pp. 2693-2697; vol. 11; No. 4; American Vacuum Society.
Techathawat, Sirirat et al.; "Exposure to heat and freezing in the vaccine cold chain in Thailand"; Vaccine; 2007; p. 1328-1333; vol. 25; Elsevier Ltd.
Thakker, Yogini et al.; "Storage of Vaccines in the Community: Weak Link in the Cold Chain?"; British Medical Journal; Mar. 21, 1992; pp. 756-758; vol. 304, No. 6829; BMJ Publishing Group.
Thompson, Marc T.; "Eddy current magnetic levitation—Models and experiments"; IEEE Potentials; Feb./Mar. 2000; pp. 40-46; IEEE.
Tripathi, A. et al.; "Hydrogen intake capacity of ZrVFe alloy bulk getters"; *Vacuum;* Bearing a date of Aug. 6, 1997; pp. 1023-1025; vol. 48; No. 12; Elsevier Science Ltd.
"Two Wire Gage / Absolute Pressure Transmitters—Model 415 and 440"; Honeywell and Sensotec; printed 2007; pp. 1-2; Located at www.sensotec.com and www.honeywell.com/sensing.
UNICEF Regional Office for Latin America & The Carribean (UNICEF-TACRO); Program for Appropriate Technology in Health (PATH); "Final Report Cold Chain Workshop," Panama City, May 31-Jun. 2, 2006; pp. 1-4 plus cover sheet, table of contents, and annexes A, B and C (22 pages total).
UOP; "An Introduction to Zeolite Molecular Sieves"; printed on Jan. 10, 2013; pp. 1-20; located at: http://www.eltrex.pl/pdf/karty/adsorbenty/ENG-Introduction%20to%20Zeolite%20Molecular%20Sieves.pdf.
U.S. Department of Health and Human Services, Centers for Disease Control and Prevention; "Recommended Immunization Schedule for Persons Aged 0 Through 6 Years—United States"; Bearing a date of 2009; p. 1.
Vesel, Alenka, et al.; "Oxidation of AISI 304L stainless steel surface with atomic oxygen"; Applied Surface Science; Bearing a date of 2002; pp. 94-103; vol. 200; Elsevier Science B.V.
Vián et al.; "Development of a thermoelectric refrigerator with two-phase thermosyphons and capillary lift"; Applied Thermal Engineering; 2008; one cover page and pp. 1-16 doi: 10.1016/j.applthermaleng.2008.09.018.
Wang, Lixia et al.; "Hepatitis B vaccination of newborn infants in rural China: evaluation of a village-based, out-of-cold-chain delivery strategy"; Bulletin of the World Health Organization; Sep. 2007; pp. 688-694; vol. 85, No. 9; World Health Organization.
Wang, et al.; "Study of a novel silica gel-water adsorption chiller. Part I. Design and performance prediction"; International Journal of Refrigeration; 2005; pp. 1073-1083; vol. 28; Elsevier Ltd and IIR.
Watanabe, S. et al.; "Reduction of outgassing rate from residual gas analyzers for extreme high vacuum measurements"; Journal of Vacuum Science Technology; Bearing a date of Nov./Dec. 1996; pp. 3261-3266; vol. 14; No. 6; American Vacuum Society.
Wei, Wei et al.; "Effects of structure and shape on thermal performance of Perforated Multi-Layer Insulation Blankets"; Applied Thermal Engineering; 2009; pp. 1264-1266; vol. 29; Elsevier Ltd.
Wiedemann, C. et al.; "Multi-layer Insulation Literatures Review"; Advances; Printed on May 2, 2011; pp. 1-10; German Aerospace Center.
Wikipedia; "Icyball"; Mar. 14, 2013; printed on Mar. 27, 2013; pp. 1-4; located at: http://en wikipedia.org/wiki/Icyball.
Williams, Preston; "Greenbox Thermal Management System Refrigerate-able 2 to 8 C. Shipping Containers"; Printed on: Feb. 9, 2011; p. 1; located at http://www.puretemp.com/documents/Refrigerate-able%202%20to%208%20C%20Shipping%20Containers.pdf.
Winn, Joshua N. et al.; "Omnidirectional reflection from a one-dimensional photonic crystal"; Optics Letters; Oct. 15, 1998; pp. 1573-1575; vol. 23, No. 20; Optical Society of America.
Wirkas, Theo, et al.; "A vaccine cold chain freezing study in PNG highlights technology needs for hot climate countries"; Vaccine; 2007; pp. 691-697; vol. 25; Elsevier Ltd.

(56) References Cited

OTHER PUBLICATIONS

World Health Organization; "Getting started with vaccine vial monitors; Vaccines and Biologicals"; World Health Organization; Dec. 2002; pp. 1-20 plus cover sheets, end sheet, contents pages, abbreviations page; revision history page and acknowledgments page (29 pages total); World Health Organization; located at www.who.int/vaccines-documents.
World Health Organization; "Getting started with vaccine vial monitors—Questions and answers on field operations"; Technical Session on Vaccine Vial Monitors, Mar. 27, 2002, Geneva; pp. 1-17 (p. 2 left intentionally blank); World Health Organization.
World Health Organization; "Guidelines on the international packaging and shipping of vaccines"; Department of Immunization, Vaccines and Biologicals; Dec. 2005; 40 pages; WHO/IVB/05.23.
World Health Organization; "Preventing Freeze Damage to Vaccines: Aide-memoire for prevention of freeze damage to vaccines"; 2007; pp. 1-4; WHO/IVB/07.09; World Health Organization.
World Health Organization; "Temperature sensitivity of vaccines"; Department of Immunization, Vaccines and Biologicals, World Health Organization; Aug. 2006; pp. 1-62 plus cover sheet, pp. i-ix, and end sheet (73 pages total); WHO/IVB/06.10; World Health Organization.
Yamakage, Michiaki; Sasaki, Hideaki; Jeong, Seong-Wook; Iwasaki, Sohshi; Namiki, Akiyoshi; "Safety and Beneficial Effect on Body Core Temperature of Prewarmed Plasma Substitute Hydroxyethyl Starch During Anesthesia" [Abstract]; Anesthesiology; 2004; p. A-1285; vol. 101; ASA.
Yamazaki, K. et al.; "High-speed pumping to UHV"; Vacuum ; Bearing a date of 2010; pp. 756-759; vol. 84; Elsevier Science Ltd.
Ye et al.; "Evaluation of Electrical Capacitance Tomography Sensors for Concentric Annulus"; IEEE Sensors Journal; Feb. 2013; pp. 446-456; vol. 13, No. 2; IEEE.
Young, J. R.; "Outgassing Characteristics of Stainless Steel and Aluminum with Different Surface Treatments"; The Journal of Vacuum Science and Technology; Bearing a date of Oct. 14, 1968; pp. 398-400; vol. 6, No. 3.
Yu et al.; "Comparison Study of Three Common Technologies for Freezing-Thawing Measurement"; Advances in Civil Engineering; 2010; pp. 1-10; doi: 10.1155/2010/239651.
Zajec, Bojan, et al.; "Hydrogen bulk states in stainless-steel related to hydrogen release kinetics and associated redistribution phenomena"; Vacuum; Bearing a date of 2001; pp. 447-452; vol. 61; Elsevier Science Ltd.
Zalba, B. et al.; "Review on thermal energy storage with phase change: materials, heat transfer analysis and applications"; Applied Thermal Engineering; Bearing a date of 2003; pp. 251-283; vol. 23; Elsevier Science Ltd.
Zhitomirskij, I.S. et al.; "A theoretical model of the heat transfer processes in multilayer insulation"; Cryogenics; Bearing a date of May 1979; pp. 265-268; IPC Business Press.
Zhu, Z. Q.; Howe, D.; "Halbach Permanent Magnet Machines and Applications: A Review"; IEE Proceedings—Electric Power Applications; Jul. 2001; pp. 299-308; vol. 148; No. 4; University of Sheffield, Department of Electronic & Electrical Engineering, Sheffield, United Kingdom.

* cited by examiner

TEMPERATURE-STABILIZED STORAGE SYSTEMS WITH INTEGRAL REGULATED COOLING

If an Application Data Sheet (ADS) has been filed on the filing date of this application, it is incorporated by reference herein. Any applications claimed on the ADS for priority under 35 U.S.C. §§119, 120, 121, or 365(c), and any and all parent, grandparent, great-grandparent, etc. applications of such applications, are also incorporated by reference, including any priority claims made in those applications and any material incorporated by reference, to the extent such subject matter is not inconsistent herewith.

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications or claims benefits under 35 USC §119(e) for provisional patent applications, for any and all parent, grandparent, great-grandparent, etc. applications of the Priority Application(s)).

PRIORITY APPLICATIONS

The present application constitutes a continuation-in-part of U.S. patent application Ser. No. 13/906,909, entitled TEMPERATURE-STABILIZED STORAGE SYSTEMS WITH REGULATED COOLING, naming Jonathan Bloedow, Ryan Calderon, David Gasperino, William Gates, Roderick A. Hyde, Edward K. Y. Jung, Shieng Liu, Nathan P. Myhrvold, Nathan John Pegram, Clarence T. Tegreene, Charles Whitmer, Lowell L. Wood, Jr. and Ozgur Emek Yildirim as inventors, filed 31 May, 2013.

The present application constitutes a continuation-in-part of U.S. patent application Ser. No. 12/658,579, entitled TEMPERATURE-STABILIZED STORAGE SYSTEMS, naming Geoffrey F. Deane, Lawrence Morgan Fowler, William Gates, Zihong Guo, Roderick A. Hyde, Edward K. Y. Jung, Jordin T. Kare, Nathan P. Myhrvold, Nathan Pegram, Nels R. Peterson, Clarence T. Tegreene, Charles Whitmer and Lowell L. Wood, Jr. as inventors, filed 8 Feb. 2010.

If the listings of applications provided above are inconsistent with the listings provided via an ADS, it is the intent of the Applicant to claim priority to each application that appears in the Domestic Benefit/National Stage Information section of the ADS and to each application that appears in the Priority Applications section of this application.

All subject matter of the Priority Applications and of any and all applications related to the Priority Applications by priority claims (directly or indirectly), including any priority claims made and subject matter incorporated by reference therein as of the filing date of the instant application, is incorporated herein by reference to the extent such subject matter is not inconsistent herewith.

SUMMARY

In some embodiments, a regulated thermal transfer device for a storage container includes: a phase change material unit, the phase change material unit including one or more walls surrounding a phase-change material region, and an aperture in the one or more walls; a heat pipe with a first end positioned within the phase change material unit, and a second end; a thermoelectric unit thermally connected to the second end of the heat pipe; a heat sink connected to the thermoelectric unit, and positioned to radiate heat away from the thermoelectric unit; and an electronic controller operably connected to the thermoelectric unit; wherein the regulated thermal transfer device is of a size and shape to be positioned so that the phase change material unit is within a storage region of a temperature-stabilized storage container, and the thermoelectric unit is positioned adjacent to an external surface of the temperature-stabilized storage container.

In some embodiments, a temperature-stabilized storage container includes: one or more sections of ultra-efficient insulation material substantially defining a temperature-stabilized storage container including a temperature-stabilized storage region with a single access aperture to the temperature-stabilized storage region; a phase change material unit attached to an internal surface of the temperature-stabilized storage region; a heat pipe with a first end positioned within the phase-change material unit, and a second end positioned adjacent to the single access aperture on an outer surface of the temperature-stabilized storage container; a thermoelectric unit in contact with the second end of the heat pipe; a heat sink connected to the thermoelectric unit and positioned to radiate heat away from the thermoelectric unit; and an electronic controller connected to the thermoelectric unit.

In some embodiments, a temperature-stabilized storage container includes: an outer wall substantially defining an outer surface of a storage container, the outer wall including an outer aperture in an upper region; an inner wall substantially defining a temperature-stabilized storage region internal to the storage container, the inner wall including an inner aperture in an upper region; a gap between the outer wall and the inner wall; a conduit connecting the outer aperture to the inner aperture; one or more sections of ultra-efficient insulation material within the gap; a phase-change material unit attached to an internal surface of the temperature-stabilized storage region; a heat pipe with a first end positioned within the phase-change material unit, and a second end positioned adjacent to the outer aperture; a thermoelectric unit in contact with the second end of the heat pipe; a heat sink connected to the thermoelectric unit and positioned to radiate heat away from the thermoelectric unit; and an electronic controller connected to the thermoelectric unit.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
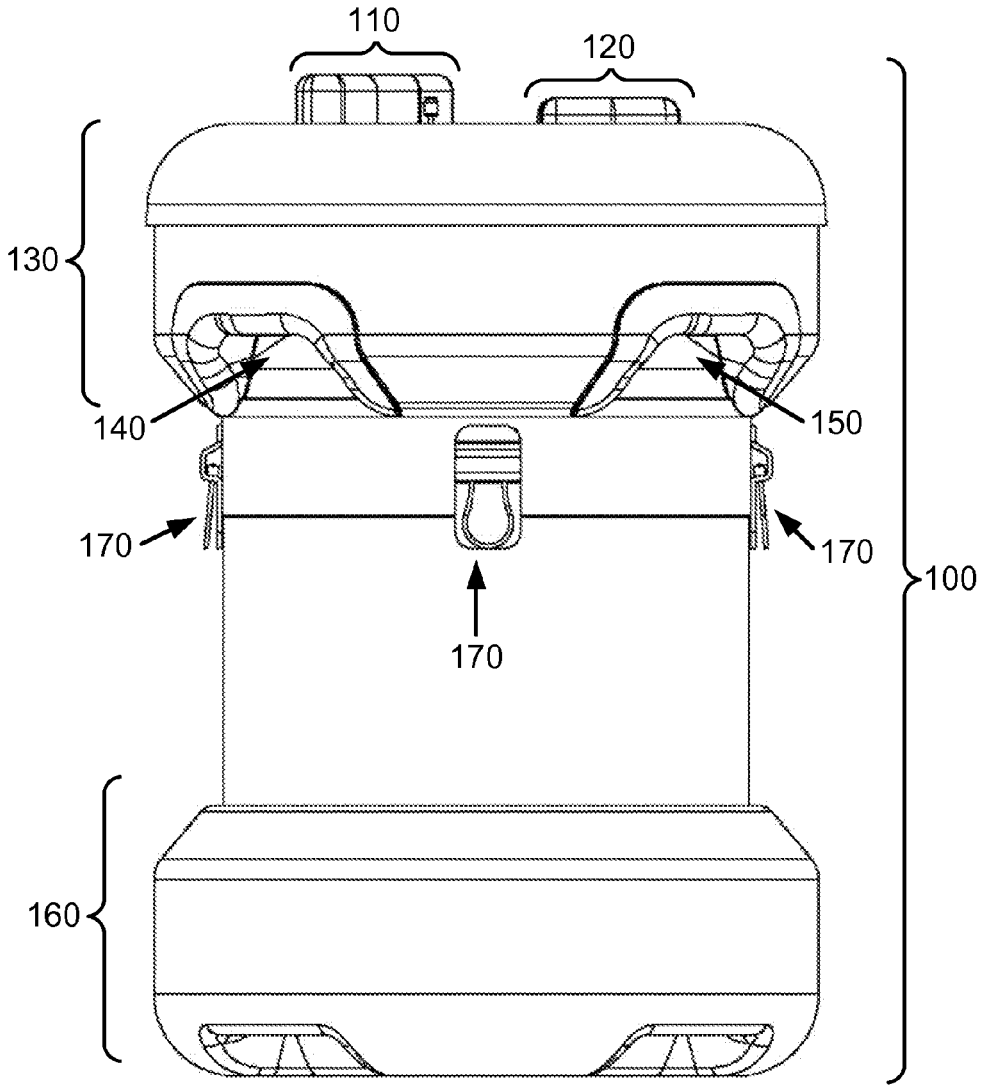
FIG. 1 is an external side view of a temperature-stabilized storage container including a regulated thermal transfer device.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

The use of the same symbols in different drawings typically indicates similar or identical items unless context dictates otherwise.

FIG. 1 shows a particular perspective of a temperature-stabilized storage container 100 including a regulated thermal transfer device, according to an embodiment. FIG. 1 illustrates a side view of a temperature-stabilized storage container 100 from the exterior. The temperature-stabilized storage container 100 includes a regulated thermal transfer device including a circuitry unit 110 and a heat sink unit 120 visible in the exterior view of FIG. 1. The temperature-stabilized storage container 100 also includes an external shell 130 attached to the top region of the temperature-stabilized storage container 100. The external shell 130 includes a plurality of apertures positioned substantially vertically within the external shell 130. In the view shown in FIG. 1, a first aperture 140 and a second aperture 150 are visible. The first and second apertures 140, 150 are positioned, inter alia, to serve as handholds for the temperature-stabilized storage container 100 for a user of the container, such as to move the position of the container within a room.

In some embodiments, a temperature-stabilized storage container includes a substantially thermally sealed storage container. See, for example, U.S. patent application Ser. No. 13/906,909, entitled TEMPERATURE-STABILIZED STORAGE SYSTEMS WITH REGULATED COOLING, naming Jonathan Bloedow, Ryan Calderon, David Gasperino, William Gates, Roderick A. Hyde, Edward K. Y. Jung, Shieng Liu, Nathan P. Myhrvold, Nathan John Pegram, Clarence T. Tegreene, Charles Whitmer, Lowell L. Wood, Jr. and Ozgur Emek Yildirim as inventors, filed 31 May, 2013, which is incorporated by reference.

In some embodiments, a temperature-stabilized storage container can be of a portable size and shape, for example a size and shape within reasonable expected portability estimates for an individual person. The temperature-stabilized storage container can be configured of a size and shape for carrying or hauling by an individual person. For example, in some embodiments the temperature-stabilized storage container has a mass that is less than approximately 50 kilograms (kg), or less than approximately 30 kg. For example, in some embodiments the temperature-stabilized storage container has a length and width that are less than approximately 1 meter (m). The temperature-stabilized storage container 100 illustrated in FIG. 1 is roughly configured as a cylindrical shape, however multiple shapes are possible depending on the embodiment. For example, a rectangular shape, or an irregular shape, can be desirable in some embodiments, depending on the intended use of the temperature-stabilized storage container.

In some embodiments, a temperature-stabilized storage container includes a base attached to the exterior of the container at a region of the container positioned to be a lower region during expected use of the container. The temperature-stabilized storage container 100 illustrated in FIG. 1 includes a base 160, which is configured to provide stability and balance to the temperature-stabilized storage container 100. For example, the base 160 can provide mass and therefore ensure stability of the temperature-stabilized storage container 100 in an upright position, or a position for its intended use. For example, the base 160 can provide mass and form a stable support structure for the temperature-stabilized storage container 100. In some embodiments, the temperature-stabilized storage container 100 is configured to be maintained in a position so that the single access aperture to a substantially thermally sealed storage region is commonly maintained substantially at the highest elevated surface of the temperature-stabilized storage container. In embodiments such as that depicted in FIG. 1, such positioning minimizes thermal transfer of heat from the region surrounding the temperature-stabilized storage container 100 into a storage region within the temperature-stabilized storage container 100. In order to maintain the thermal stability of a storage region within the temperature-stabilized storage container 100 over time, thermal transfer of heat from the exterior of the temperature-stabilized storage container 100 into the temperature-stabilized storage container 100 is not desirable. A base 160 of sufficient mass can be configured to encourage maintenance of the temperature-stabilized storage container 100 in an appropriate position for the embodiment during use. A base 160 of sufficient mass can be configured to encourage maintenance of the temperature-stabilized storage container 100 in an appropriate position for minimal thermal transfer into a storage region within the temperature-stabilized storage container 100 from a region exterior to the temperature-stabilized storage container 100. In some embodiments, an external wall of an access conduit can be elongated and/or nonlinear to create an elongated thermal pathway between the exterior of the container 100 and the interior of the container.

The temperature-stabilized storage container 100 can include, in some embodiments, one or more handles 170 attached to an exterior surface of the container 100, wherein the handles 170 are configured for transport of the container 100. The handles can be fixed on the surface of the container, for example welded, fastened or glued to the surface of the container. The handles can be operably attached but not fixed to the surface of the container, such as with a harness, binding, hoop or chain running along the surface of the container. The handles can be positioned to retain the container with an access conduit on the top of the container during transport to minimize thermal transfer from the exterior of the container through the access conduit.

The temperature-stabilized storage container can include electronic components. For example, FIG. 1 depicts a circuitry unit 110 positioned at the top of the container 100. Although it may be desirable, depending on the embodiment, to minimize thermal emissions (i.e. heat output) within the container, electronics with thermal emissions can be operably attached to the exterior of the container without providing heat to the interior of the container. For example, FIG. 1 depicts a heat sink unit 120 positioned adjacent to the top edge of the container 100. For example, one or more positioning devices, such as GPS devices, can be attached to the exterior of the container. One or more positioning devices can be configured as part of a system including, for example, monitors, displays, circuitry, power sources, an operator unit, and transmission units. To the extent that circuitry is positioned within the interior region of a container during use of an embodiment, it is selected for low thermal emission properties as well as positioned and utilized to minimize thermal emissions.

Depending on the embodiment, one or more power sources can be attached to the temperature-stabilized storage container, wherein the power source is configured to supply power to circuitry within the container or within a regulated thermal transfer device affixed to the container. For example, a photovoltaic unit can be attached to the exterior surface of the temperature-stabilized storage container. For example, a photovoltaic unit can be attached to a building or structure that the container is placed within, and a wire or similar electrical conduit can connect the circuitry within the container or within a regulated thermal transfer device affixed to the container to the external photovoltaic unit. For example, a battery unit can be attached to the exterior surface of the temperature-stabilized storage container. For example, one or more wires can be positioned within an access conduit of the temperature-stabilized storage container to supply power to circuitry within the container or within a regulated thermal transfer device affixed to the temperature-stabilized storage container. For example, one or more power sources can be attached to an exterior surface of the temperature-stabilized storage container, wherein the power source is configured to supply power to circuitry within the container. For example, one or more power sources can be attached to an exterior surface of the temperature-stabilized storage container, wherein the power source is configured to supply power to circuitry integral to a regulated thermal transfer device affixed to the temperature-stabilized storage container. A power source can include wirelessly transmitted power sources, such as described in U.S. Patent Application No. 2005/0143787 to Boveja, titled "Method and system for providing electrical pulses for neuromodulation of vagus nerve(s), using rechargeable implanted pulse generator," which is herein incorporated by reference. A power source can include a magnetically transmitted power source. A power source can include a battery. A power source can include a solar panel, such as a photovoltaic panel. A power source can include an AC power source with a converter to supply DC current to the circuitry within the temperature-stabilized storage container or within a regulated thermal transfer device affixed to the temperature-stabilized storage container.

Depending on the embodiment, one or more temperature sensors can be attached to an exterior surface of the temperature-stabilized storage container. The one or more temperature sensors can be configured, for example, to display the ambient temperature at the surface of the temperature-stabilized storage container. The one or more temperature sensors can be configured, for example, to transmit data to one or more system. The one or more temperature sensors can be configured, for example, as part of a temperature monitoring system.

Depending on the embodiment, one or more transmission units can be operably attached to the temperature-stabilized storage container. For example, one or more transmission units can be operably attached to the exterior surface of the temperature-stabilized storage container. For example, one or more transmission units can be operably attached to an interior unit within the temperature-stabilized storage container. For example, one or more transmission units can be operably attached to the regulated thermal transfer device affixed to the temperature-stabilized storage container. Depending on the embodiment, one or more receiving units can be operably attached to the temperature-stabilized storage container. For example, one or more receiving units can be operably attached to the exterior surface of the temperature-stabilized storage container. For example, one or more receiving units can be operably attached to an interior unit within the temperature-stabilized storage container. For example, one or more receiving units can be operably attached to the regulated thermal transfer device affixed to the temperature-stabilized storage container.

Figure 2:
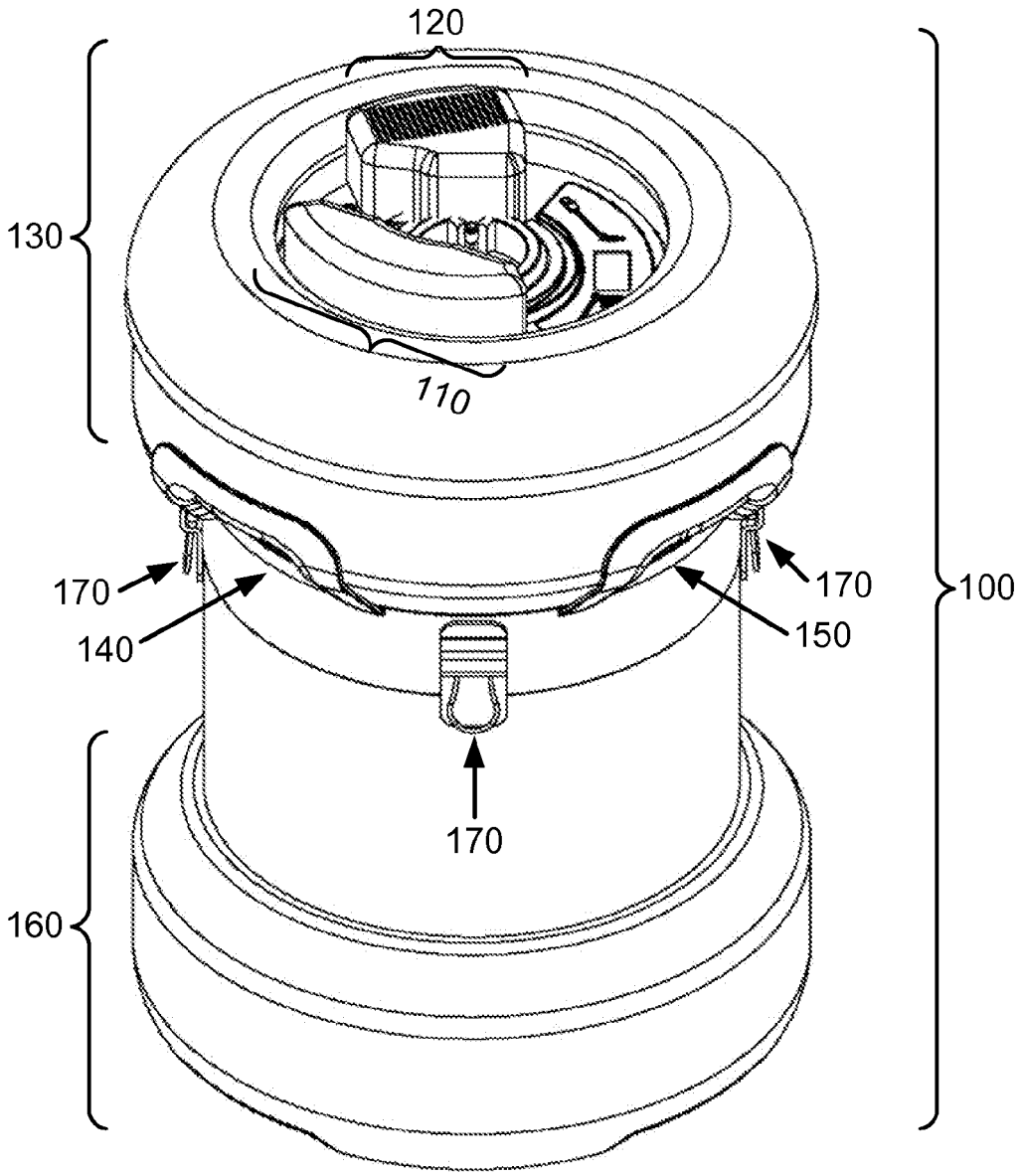
FIG. 2 is an external isometric view of a temperature-stabilized storage container including a regulated thermal transfer device.

FIG. 2 depicts an isometric external view of a temperature-stabilized storage container 100. The temperature-stabilized storage container 100 includes a regulated thermal transfer device including a circuitry unit 110 and a heat sink unit 120 visible in the exterior view of FIG. 2. The heat sink unit 120 includes a plurality of linear slits in a cover of the heat sink unit 120, the plurality of slits positioned to provide air flow between a region adjacent to the heat sink unit 120 and the interior of the heat sink unit 120. The temperature-stabilized storage container 100 also includes an external shell 130 attached to the top region of the temperature-stabilized storage container 100. The external shell 130 includes a plurality of apertures positioned substantially vertically within the external shell 130. The embodiment shown in FIG. 2 includes a plurality of handles 170 affixed to the exterior of the temperature-stabilized storage container 100. The embodiment illustrated includes a base 160 affixed to a lower region of the temperature-stabilized storage container 100. The external shell 130 and the base 160 are affixed to distal ends of the temperature-stabilized storage container 100 illustrated in FIG. 2.

Figure 3:
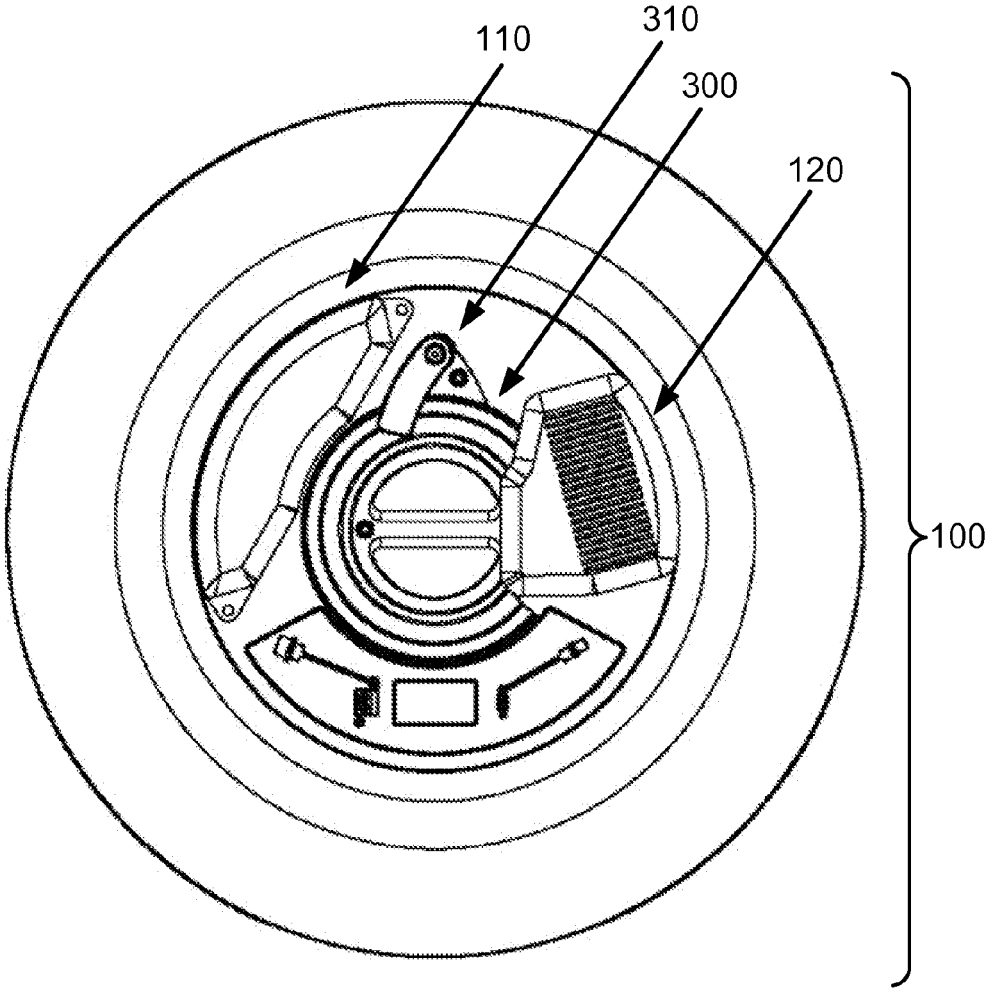
FIG. 3 is an external, top-down view of a temperature-stabilized storage container including a regulated thermal transfer device.

FIG. 3 illustrates an embodiment of a temperature-stabilized storage container 100 in a top-down view. The temperature-stabilized storage container 100 includes a regulated thermal transfer device including a circuitry unit 110 and a heat sink unit 120 visible in the view of FIG. 3. The heat sink unit 120 includes a plurality of slits in the visible cover to the heat sink unit, the slits positioned to provide airflow through the cover. A lid 300 covers a single access aperture to the interior storage region within the temperature-stabilized storage container 100. The lid 300 is attached to hinges 310 positioned to move the lid 300 as desired by a user to access the interior storage region of the container.

Figure 4:
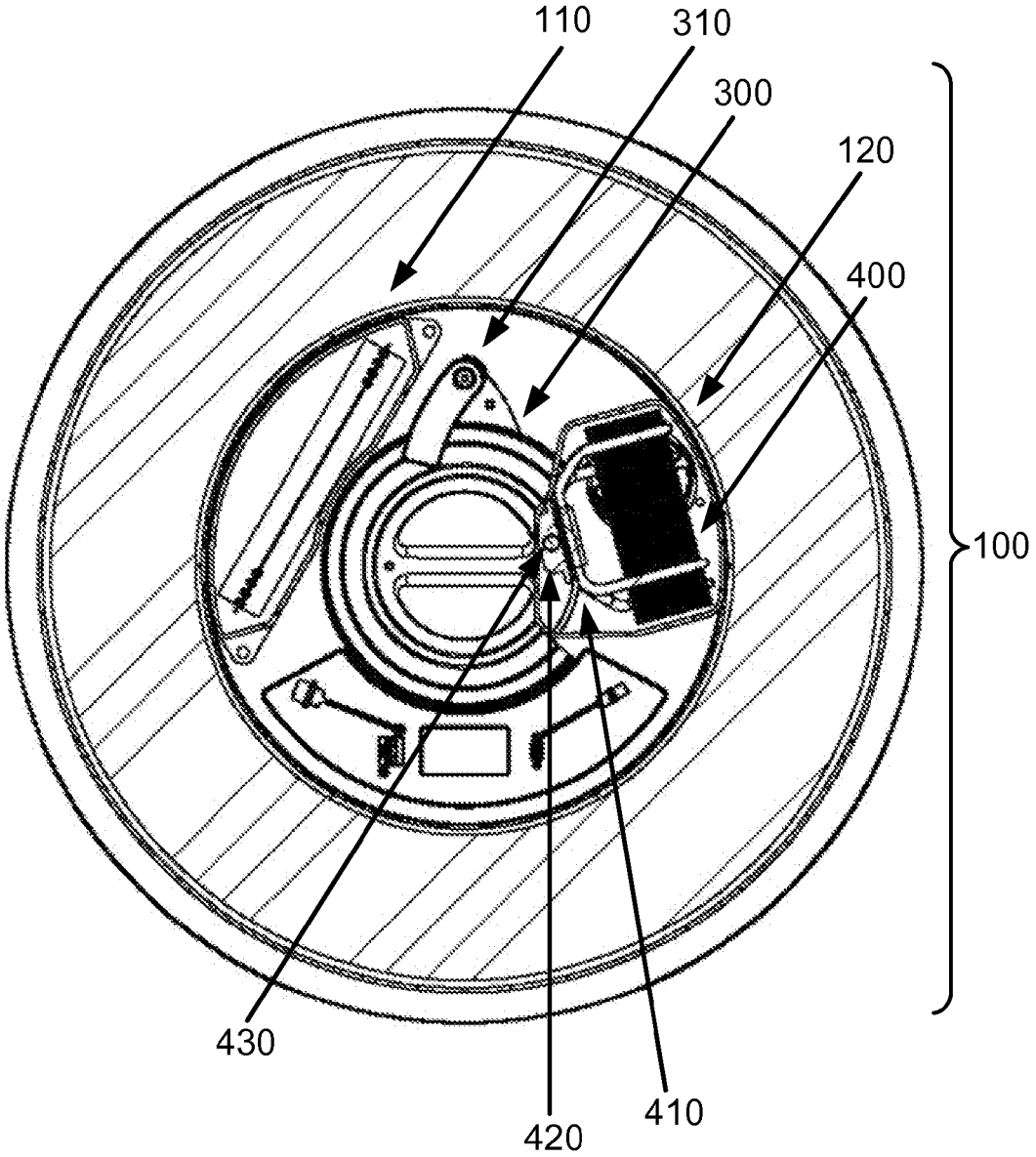
FIG. 4 is a top-down view of a temperature-stabilized storage container including a regulated thermal transfer device with covers removed.

FIG. 4 shows an embodiment of temperature-stabilized storage container 100 in a top-down view. In the embodiment shown in FIG. 4, the circuitry unit 110 and a heat sink unit 120 of a regulated thermal transfer device integral to the container do not include covers. The interior regions of the circuitry unit 110 and the heat sink unit 120 are partially illustrated in the view of FIG. 4. The heat sink unit 120 includes a plurality of planar thermal transfer units positioned substantially horizontally relative to the usual orientation of the container (e.g. as shown in FIG. 1). A top thermal transfer unit 400 is visible in the view of FIG. 4 as a substantially planar sheet. The heat sink unit 120 also includes a plurality of heat pipes 410 affixed to a heat transfer unit 420. The heat transfer unit 420 includes a thermally-conductive block surrounding a top end of a heat pipe 430. The heat pipe 430 is positioned substantially at right angles to the view shown in FIG. 4, so in this view it is visible as a circular cross-section of the heat pipe 430.

Figure 5:
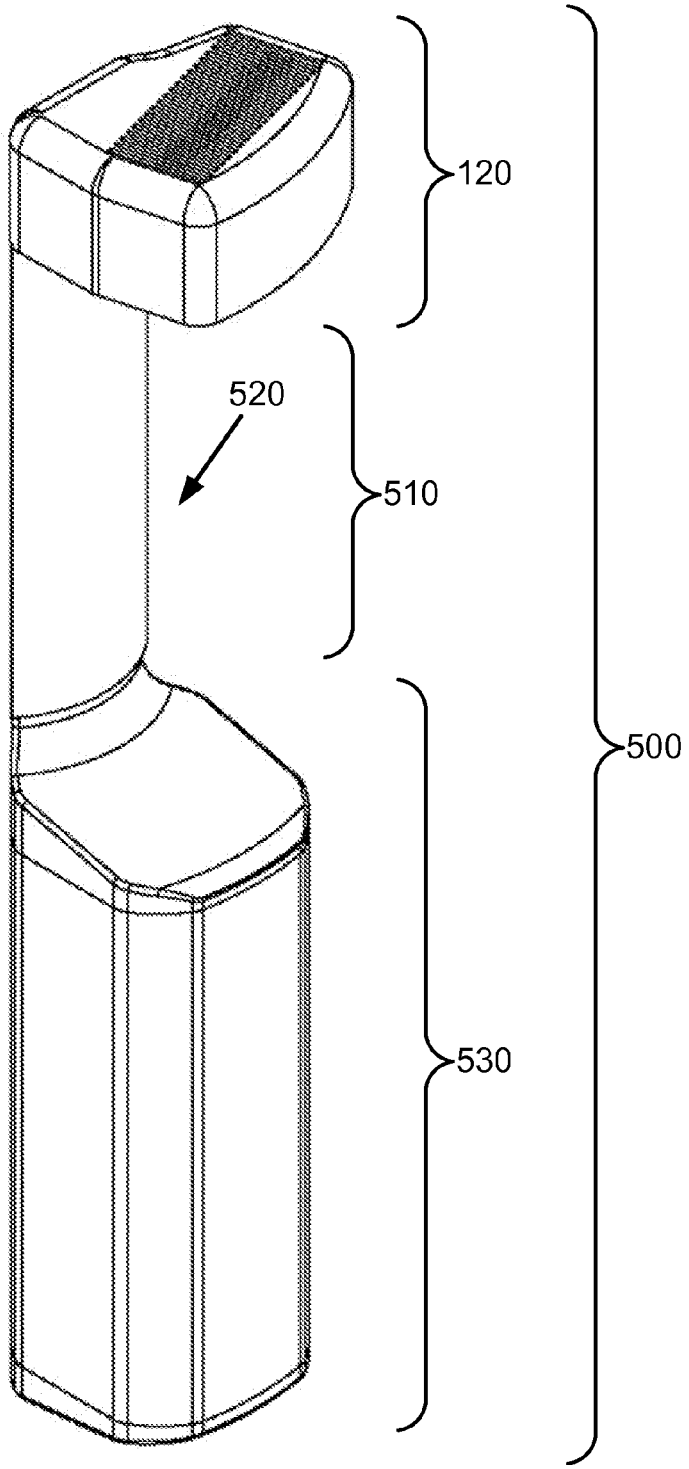
FIG. 5 is an external view of a regulated thermal transfer device.

FIG. 5 illustrates an external view of a portion of a regulated thermal transfer device 500. The regulated thermal transfer device 500 portion shown in FIG. 5 is attached to a temperature-stabilized storage container during use, along with an attached circuitry unit (not shown in FIG. 5). The regulated thermal transfer device is of a size and shape to be positioned so that the phase change material unit is within a storage region of a temperature-stabilized storage container during use of the device. The regulated thermal transfer device 500 illustrated in FIG. 5 includes an external cover surrounding the structure. The regulated thermal transfer device 500 shown in FIG. 5 is attached to a circuitry unit during use with a temperature-stabilized storage container. The portion of a regulated thermal transfer device 500 shown in FIG. 5 includes a heat sink unit 120 at the top of the device 500. The heat sink unit 120 includes a plurality of slits in the top portion of the cover surrounding the heat sink unit 120. The slits create apertures through the cover at the top of the heat sink unit 120. The heat sink unit 120 is affixed at its lower edge to an adiabatic region 510 of the regulated thermal transfer device 500. The adiabatic region 510 includes a cover with a surface 520 configured to reversibly mate with the interior surface of an access conduit of a temperature-stabilized storage container during use of the device with the container. The portion of a regulated thermal transfer device 500 shown in FIG. 5 includes a phase change material unit 530. The phase change material unit 530 includes walls surrounding a phase-change material region interior to the walls.

In some embodiments, a regulated thermal transfer device includes a phase change material unit, the phase change material unit including one or more walls surrounding a phase-change material region, and an aperture in the one or more walls. For example, in the illustrated embodiment of FIG. 5, wherein the aperture in the walls surrounding the phase change material unit 530 is attached to a corresponding aperture in the cover surrounding the adiabatic region 510. In some embodiments, the phase change material unit includes an aperture surrounding a heat pipe, and a seal connecting the aperture to the heat pipe. In some embodiments, the phase change material unit includes a sealed container substantially filled with a phase-change material. In some embodiments, the phase change material unit includes a sealed container including a hydrocarbon-based phase-change material within an expanded graphite structure. In some embodiments, the phase change material unit includes an attachment region positioned to attach the phase change material unit to a surface of the storage region of the temperature-stabilized storage container. For example, the external cover of the phase change material unit can include one or more fasteners positioned to mate with the interior surface of the storage region of the temperature-stabilized storage container. In some embodiments, the phase change material unit includes a phase change material substantially filling a sealed interior region of the phase change material unit, the phase change material having a freeze temperature between about 0° C. to about 2° C. In some embodiments, the phase change material has a freeze temperature between about 1° C. to about 3° C. In some embodiments, the phase change material has a freeze temperature between about 2° C. to about 4° C. In some embodiments, the phase change material has a freeze temperature between about 3° C. to about 5° C. In some embodiments, the phase change material has a freeze temperature between about 4° C. to about 6° C. In some embodiments, the phase change material unit includes a phase change material as well as expansion space sufficient to include the phase change material in a different phase. For example, in some embodiments the phase change material includes water and the phase change material unit includes sufficient expansion space to contain the water in a frozen state.

In some embodiments, the phase change material unit includes additional material positioned in a location to encourage freezing of the phase change material at that location. In some embodiments, the phase change material unit includes one or more nucleation agents. For example, a phase change material unit can include water as a phase change material and nucleation agents, such as silver iodide or plant-based nucleating agents such as Ina proteins from *Pseudomonas syringae*. In some embodiments, the phase change material unit includes a mechanical shock unit, such as a piezo actuator or a solenoid unit positioned to nucleate ice formation in supercooled phase change material, such as water. In some embodiments, a phase change material includes a second thermoelectric unit positioned to provide additional cooling to the phase change material unit.

"Phase change material" as used herein, includes materials that change their state (e.g. liquid to solid) at specific temperatures with a high heat of fusion. For example, in some embodiments the phase change material is water or ice. For example, in some embodiments the phase change material is an organic or inorganic material. The phase change material for an embodiment can be selected based on factors such as cost, thermal capacity, toxicity, mass and freezing temperature for a specific phase change material. In some embodiments a phase change material includes PureTemp™ 4 (available from Entropy Solutions Inc.), with a melting point of 5° C. In some embodiments a phase change material includes Phase 5™, (available from Cryopak Inc.), with a melting point of 5° C. In some embodiments a phase change material includes materials with a melting point up to 8° C. In some embodiments a phase change material includes materials with a melting point between 2° C. and 8° C. In some embodiments, the phase change material is a hydrocarbon-based material. In some embodiments, the phase change material is a salt-water solution. In some embodiments, the phase change material is a salt-hydrate solution, wherein the salt is present in a crystalline form. In some embodiments, the phase change material is a salt eutectic solution. In some embodiments, the phase change material includes one or more clathrates, for example tetrahydrofuran clathrate. In some embodiments, the phase change material is structured as beads or pellets within the phase change material unit. In some embodiments, the phase change material is structured as a solid or semi-solid three-dimensional unit within the phase change material unit, so that no internal containment structure for the phase change material is required. For example, in some embodiments a phase change material can be structured as a semi-solid gel, or a solid crystalline array.

In some embodiments, a phase change material unit can include one or more additional elements positioned to enhance thermal transfer within the phase change material unit. For example, in some embodiments the phase change material unit includes an expanded graphite material saturated with a hydrocarbon-based phase change material. For example, during manufacture, one or more 10% graphite sheets can be saturated with a hydrocarbon-based phase change material and the combined materials positioned within a phase change material unit. In some embodiments, a phase change material unit can include one or more thermal conduction elements, such as plate structures, linear structures, or other features fabricated from thermally-conductive material and positioned within the phase change material unit in a manner to enhance thermal transfer within the phase change material unit. For example, in some embodiments a phase change material unit can include one or more mesh structures fabricated from copper and positioned to enhance thermal transfer within the phase change material unit.

The phase change material unit illustrated in FIG. 5 is a solid structure. In some embodiments, a phase change material unit is a folded or compressed structure that is unfolded or expanded during addition of the regulated thermal transfer device to a temperature-stabilized storage container. For example, in some embodiments, a phase change material unit includes a balloon-type structure that is initially inserted into the storage region interior to a temperature-stabilized storage container without phase change material (e.g. in a "deflated" state). Subsequently, the phase change material unit can be filled with a phase change material, such as through a tube positioned within the adiabatic region of the regulated thermal transfer device. As the balloon-type structure of the phase change material unit is filled with the phase change material, it expands in position within the storage region interior to a temperature-stabilized storage container in a manner for use.

In some embodiments, a regulated thermal transfer device also includes a phase change material unit with a second internal container including phase change material. For example, a second internal container can include the same phase change material as the main container. For example, a second internal container can include a second phase change material. For example, the second internal container can include an internal enclosure with phase change material sealed within the internal closure. In some embodiments, a phase change material unit includes a plurality of internal containers, each including phase change material. The phase change material can be the same in each of the plurality of internal containers. The phase change material can be different among the plurality of internal containers. The one or more internal containers within the phase change material unit can be positioned, for example, between the exterior of the phase change material unit and the heat pipe within the phase change material unit. The one or more internal containers within the phase change material unit can be positioned, for example, between the internal storage region of the container and the heat pipe within the phase change material unit.

In some embodiments, a regulated thermal transfer device also includes a heat pipe with a first end positioned within the phase change material unit, and a second end traversing the aperture of the one or more walls of the phase change material unit. For example, in some embodiments the heat pipe includes a substantially tubular structure. For example, in some embodiments the heat pipe includes a substantially vertical structure when the regulated thermal transfer device is positioned for use within a storage container. See, e.g. FIGS. 12 and 13. For example, in some embodiments the heat pipe is configured to be positioned substantially vertically when it is affixed to the temperature-stabilized storage container. For example, in some embodiments the heat pipe includes a plurality of thermal conduction structures positioned within the phase-change material unit and configured to transfer heat from the phase change material to the heat pipe. For example, in some embodiments a heat pipe has a plurality of planar thermal conduction structures thermally attached to its outer surface. For example, the thermal conduction structures can be fabricated from a thermally-conductive material, such as copper or silver. For example, in some embodiments the heat pipe includes a plurality of thermal conduction structures including a plurality of planar structures attached to the heat pipe at substantially right angles.

In some embodiments, a regulated thermal transfer device also includes a thermoelectric unit thermally connected to the second end of the heat pipe. The thermoelectric unit is positioned adjacent to an external surface of the temperature-stabilized storage container. For example, in some embodiments the thermoelectric unit includes a Peltier device. For example, in some embodiments the thermoelectric unit is positioned to transfer thermal energy away from the second end of the heat pipe. For example, in some embodiments the thermoelectric unit is positioned to transfer thermal energy to the heat sink connected to the thermoelectric unit. For example, the thermoelectric unit can include a side in thermal contact with a heat sink.

In some embodiments, a regulated thermal transfer device also includes a heat sink connected to the thermoelectric unit, and positioned to radiate heat away from the thermoelectric unit. For example, in some embodiments the heat sink includes a passive heat sink device. For example, a passive heat sink can include unpowered components, such as radiative fins, a heat block, and one or more heat pipes positioned to radiate heat away from the thermoelectric unit. For example, in some embodiments the heat sink includes an active heat sink device, the active heat sink device operably coupled to the controller. For example, an active heat sink device can include one or more fan units positioned to circulate air and thereby radiate heat away from the thermoelectric unit. For example, in some embodiments a fan is attached to a shell (see, e.g. shell 130 in FIG. 1) in a position adjacent to an aperture in the shell (see, e.g. apertures 140, 150 in FIG. 1) and in a position to direct air through the aperture and away from the thermoelectric unit.

In some embodiments, a regulated thermal transfer device also includes an electronic controller operably connected to the thermoelectric unit. For example, in some embodiments an electronic controller is included within a circuitry unit (see, e.g. FIGS. 1 through 4). For example, in some embodiments an electronic controller includes circuitry configured to control the thermoelectric unit of the regulated thermal transfer device. For example, in some embodiments an electronic controller includes circuitry configured to control the thermoelectric unit in response to signals received from at least one temperature sensor. For example, in some embodiments an electronic controller includes circuitry configured to control the thermoelectric unit in response to signals received from at least one temperature sensor attached to the cover of the phase change material unit. For example, in some embodiments an electronic controller includes circuitry configured to control the thermoelectric unit in response to signals received from at least one temperature sensor attached to the interior of a storage region of the temperature-stabilized storage container.

Some embodiments of a regulated thermal transfer device also include a temperature sensor attached to the phase change material unit; and a connector between the temperature sensor and the electronic controller. For example, an electronic temperature sensor can be attached to the wall of a phase change material unit and a wire connector can be positioned within the phase change material unit, traversing the adiabatic region of the regulated thermal transfer device, and connected to an electronic controller within the attached a circuitry unit. Some embodiments of a regulated thermal transfer device also include a connector attached to the electronic controller, the connector configured to provide electricity to the regulated thermal transfer device from an external power source. For example, in some embodiments an external power source includes a photovoltaic unit. For example, in some embodiments an external power source includes a battery. For example, in some embodiments an external power source includes a municipal power supply.

Some embodiments of a regulated thermal transfer device also include a communications unit operably coupled to the electronic controller. For example, a communications unit can include a transmitter, such as a Bluetooth™ transmitter. For example, a communications unit can include a receiver. For example, a communications unit can include an antenna. For example, a communications unit can include a digital memory device.

Some embodiments of a regulated thermal transfer device also include a second phase change material unit including one or more walls surrounding a phase-change material region, and an aperture in the one or more walls, and a second heat pipe with a first end positioned within the second phase change material unit, and a second end thermally connected to the thermoelectric unit. The second phase change material unit can be configured, for example, to be positioned distal to the first phase change material unit within a storage region of the temperature-stabilized storage container. The second phase change material unit can be configured, for example, to be positioned within a second storage region of the temperature-stabilized storage container.

Figure 6:
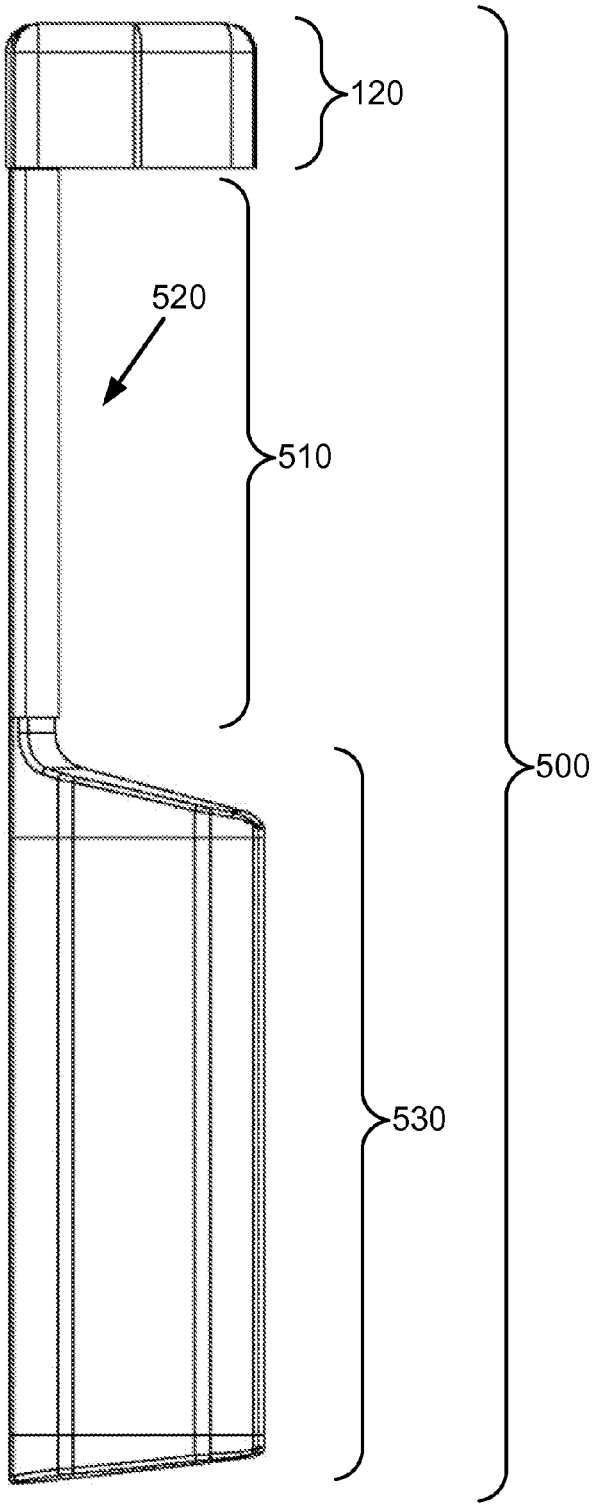
FIG. 6 is an external, side view of a regulated thermal transfer device.

FIG. 6 illustrates an external view of a portion of an embodiment of a regulated thermal transfer device 500. During use, the regulated thermal transfer device 500 portion shown in FIG. 6 is attached to a temperature-stabilized storage container along with an attached circuitry unit (not shown in FIG. 6). The regulated thermal transfer device 500 shown in FIG. 6 includes an external cover surrounding the structure. The portion of a regulated thermal transfer device 500 shown in FIG. 6 includes a heat sink unit 120 at the top of the device 500. The heat sink unit 120 is affixed at its lower edge to an adiabatic region 510 of the regulated thermal transfer device 500. The adiabatic region 510 includes a cover with a surface 520 configured to reversibly mate with the interior surface of an access conduit of a temperature-stabilized storage container during use of the device with the container. The portion of a regulated thermal transfer device 500 shown in FIG. 6 includes a phase change material unit 530.

Figure 7:
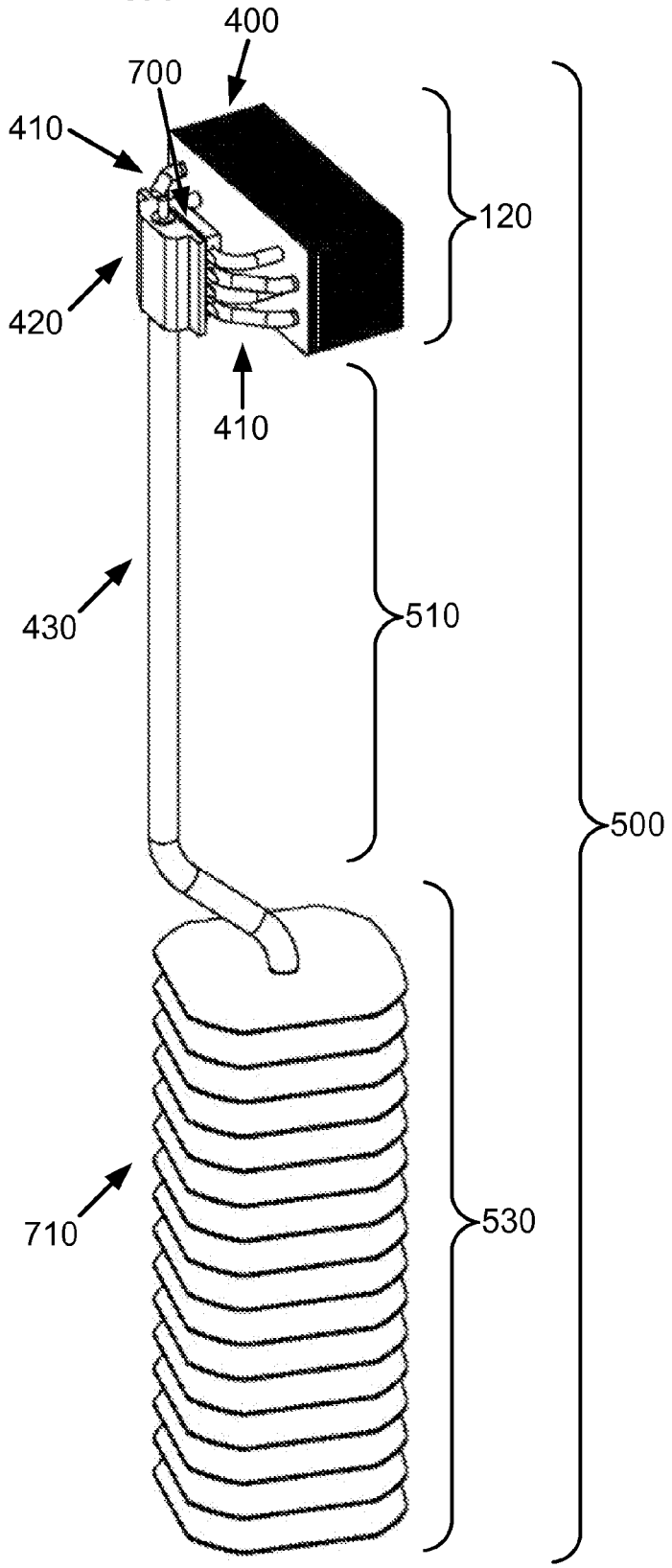
FIG. 7 is a view of a regulated thermal transfer device with the covers removed.

FIG. 7 illustrates a portion of an embodiment of a regulated thermal transfer device 500. The regulated thermal transfer device 500 shown in FIG. 7 has the cover removed to illustrate interior features of the regulated thermal transfer device 500. The regulated thermal transfer device 500 includes a heat sink unit 120 at the top of the device 500. The top end of a heat pipe 430 is positioned within the heat sink unit 120. A heat transfer unit 420 is in physical contact with the top end of the heat pipe 430. The heat sink unit 120 includes a thermal transfer unit 400. The heat sink unit 120 also includes a plurality of heat pipes 410 affixed to the heat transfer unit 420, the heat pipes 410 also attached to the thermal transfer unit 400. A thermoelectric device 700 is thermally connected to the top end of the heat pipe 430. The thermoelectric unit 700 is positioned to transfer heat from the top end of the heat pipe 430 to the thermal transfer unit 400. In the embodiment illustrated in FIG. 7, the thermoelectric unit 700 is a Peltier device.

FIG. 7 illustrates that the regulated thermal transfer device 500 includes an adiabatic region 510. In some embodiments, an adiabatic region includes one or more wires, one or more tubes, or other features described elsewhere within. In the embodiment shown in FIG. 7, the adiabatic region 510 includes an adiabatic section of the heat pipe 430.

FIG. 7 shows that the regulated thermal transfer device 500 includes a phase change material unit 530 at the lower end of the regulated thermal transfer device 500. The phase change material unit 530 would include a phase change material, not shown in FIG. 7. In the embodiment illustrated in FIG. 7, the phase change material unit 530 includes a plurality of planar structures 710 attached to the heat pipe 430 at substantially right angles. The plurality of planar structures 710 are configured to enhance thermal efficiency through the phase change material unit 530. Some embodiments include a plurality of planar structures 710 that are fabricated from a thermally-conductive material, such as copper, silver, or aluminum. Some embodiments include a plurality of planar structures 710 that includes a plurality of apertures, such as mesh structures.

Figure 8:
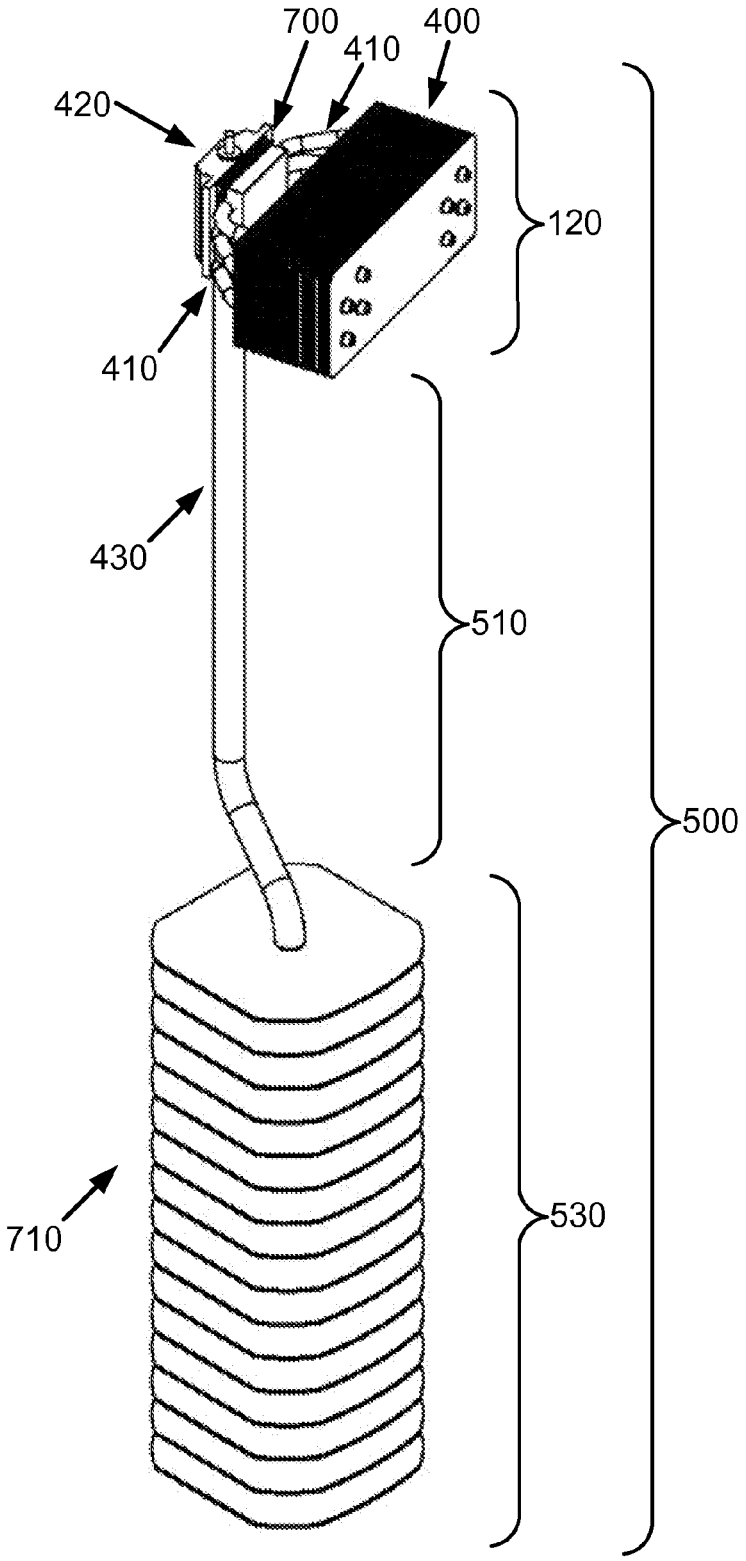
FIG. 8 is a view of a regulated thermal transfer device with the covers removed.

FIG. 8 illustrates a portion of an embodiment of a regulated thermal transfer device 500 with the cover removed to depict interior aspects of the device. As shown in FIG. 8, the regulated thermal transfer device 500 includes a heat sink unit 120 at the top of the device 500. The regulated thermal transfer device 500 depicted includes an adiabatic region 510 in the center of the device. The regulated thermal transfer device 500 shown includes a phase change material unit 530 at the lower end of the device. In the embodiment illustrated in FIG. 8, the heat sink unit 120 includes a heat transfer unit 420 positioned in physical contact with the top end of the heat pipe 430. The heat sink unit 120 includes a thermal transfer unit 400. The heat sink unit 120 also includes a plurality of heat pipes 410 affixed to the heat transfer unit 420, the heat pipes 410 also attached to the thermal transfer unit 400. A thermoelectric device 700 is thermally connected to the top end of the heat pipe 430. The thermoelectric unit 700 is positioned to transfer heat from the top end of the heat pipe 430 to the thermal transfer unit 400. The heat pipe 430 traverses the adiabatic region 510 and includes a lower end within the phase change material unit 530. The phase change material unit 530 includes a plurality of planar structures 710 connected to the lower region of the heat pipe 430 and positioned to improve thermal transfer between the heat pipe 430 and phase change material (not shown) within the phase change material unit 530.

Figure 9:
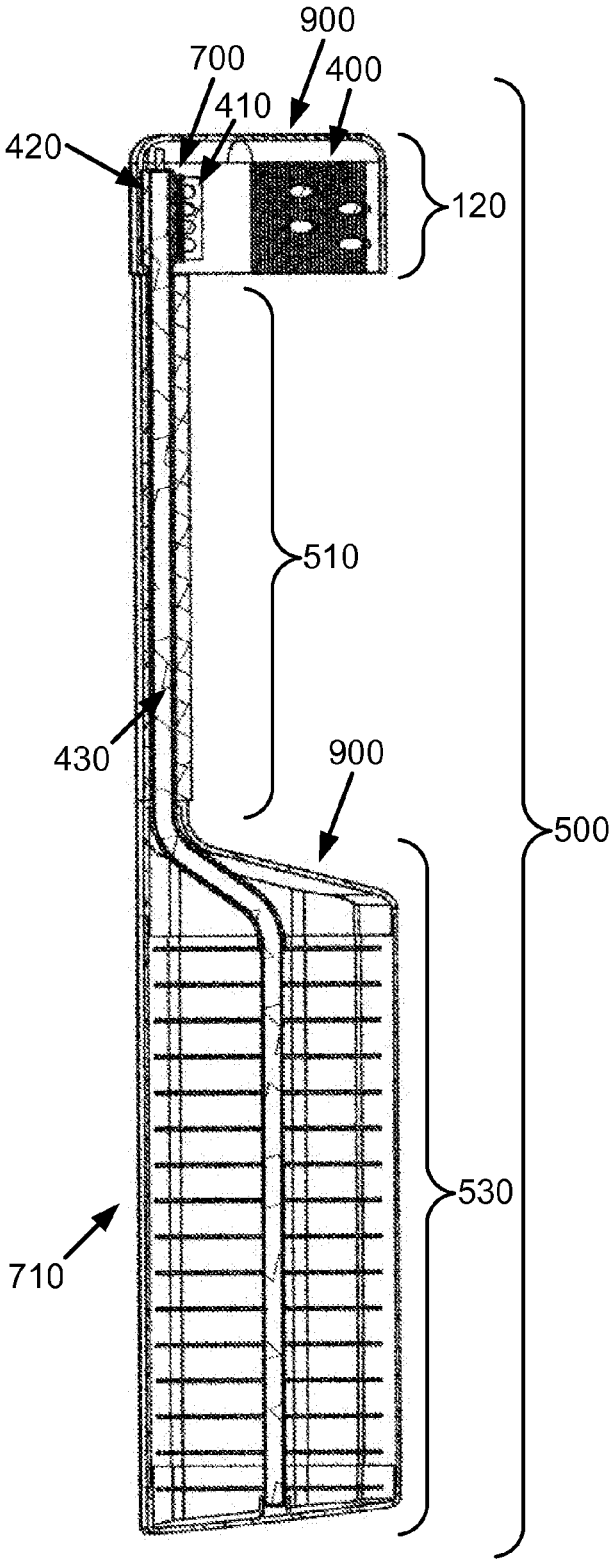
FIG. 9 is a substantially vertical cross-section view of a regulated thermal transfer device.

FIG. 9 illustrates a substantially cross-section view of a portion of a regulated thermal transfer device 500. The embodiment illustrated includes a cover 900 surrounding the exterior of the shown regulated thermal transfer device 500. In some embodiments, a cover can be configured as a thin wall or shell surrounding the exterior of the regulated thermal transfer device. For example, in some embodiments a cover can be fabricated from a sturdy plastic or fiberglass material. The portion of a regulated thermal transfer device 500 shown in FIG. 9 includes a heat sink unit 120, an adiabatic region 510 and a phase change material unit 530. The heat sink unit 120 illustrated in FIG. 9 includes a heat transfer unit 420 positioned in physical contact with the top end of the heat pipe 430. The heat sink unit 120 includes a thermal transfer unit 400. The heat sink unit 120 also includes a plurality of heat pipes 410 affixed to the heat transfer unit 420, the heat pipes 410 also attached to the thermal transfer unit 400. A thermoelectric device 700 is thermally connected to the top end of the heat pipe 430. The thermoelectric unit 700 is positioned to transfer heat from the top end of the heat pipe 430 to the thermal transfer unit 400. The embodiment illustrated includes a heat pipe 430 traversing the adiabatic region 510 within the cover 900. The heat pipe 430 includes a lower end substantially coexistent with the lower face of the phase change material unit 530. The phase change material unit 530 includes a plurality of planar structures 710 connected to the lower region of the heat pipe 430 and positioned to improve thermal transfer between the heat pipe 430 and phase change material (not shown) within the phase change material unit 530. During use, phase change material (not shown) would substantially fill the interior of the phase change material unit 530 substantially up to the edge of the adiabatic region 510.

Figure 10:
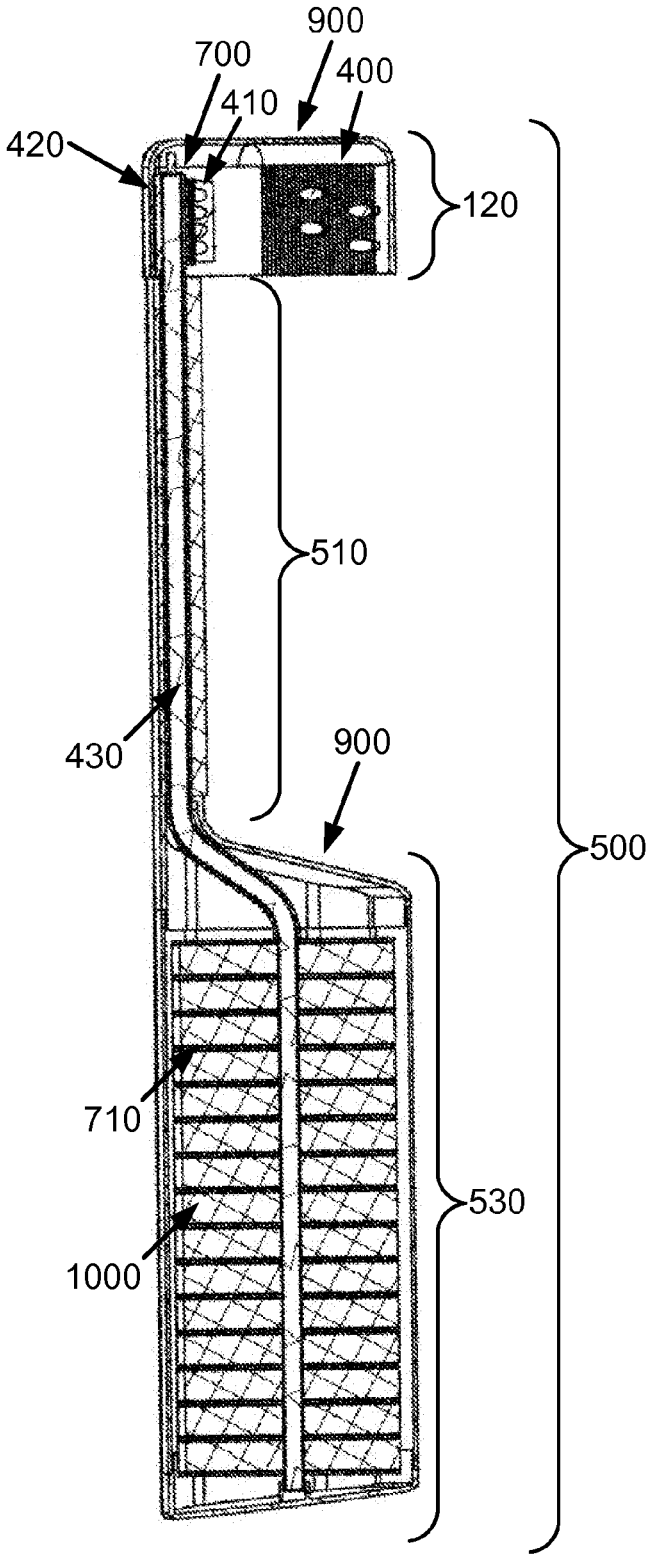
FIG. 10 is a substantially vertical cross-section view of a regulated thermal transfer device.

FIG. 10 shows aspects of a partial embodiment of a regulated thermal transfer device 500 as a substantially cross-section view. During use, the regulated thermal transfer device 500 is positioned within and attached to a temperature-stabilized storage container along with an attached circuitry unit (not shown in FIG. 10). The embodiment illustrated includes a cover 900 surrounding the exterior of the shown regulated thermal transfer device 500. The portion of a regulated thermal transfer device 500 shown in FIG. 10 includes a heat sink unit 120, an adiabatic region 510 and a phase change material unit 530. The heat sink unit 120 includes a heat transfer unit 420 in direct thermal contact with the top end of the heat pipe 430. The heat sink unit 120 includes a thermal transfer unit 400. The heat sink unit 120 also includes a plurality of heat pipes 410 affixed to the heat transfer unit 420. The heat pipes 410 are embedded in the thermal transfer unit 400 and positioned to effectuate thermal transfer from the heat pipes 410 to the thermal transfer unit 400. A thermoelectric device 700 is thermally connected to the top end of the heat pipe 430. The thermoelectric device 700 is connected to a controller in an attached circuitry unit (not shown in FIG. 10). During use, the controller regulates the operation of the thermoelectric device 700 in response to input from at least one temperature sensor. For example, in some embodiments one or more temperature sensors can be placed adjacent to the cover 900 of the phase change material unit 530 and connected to an attached circuitry unit with a wire connector.

The embodiment illustrated in FIG. 10 includes a phase change material unit 530. The phase change material unit 530 includes a cover 900 surrounding the exterior of the phase change material unit 530. In some embodiments, the cover of the phase change material unit is contiguous with the cover of the entire regulated thermal transfer device. In the embodiment shown in FIG. 10, the phase change material unit 530 includes a plurality of thermal conduction structures 710 positioned within the phase-change material unit 530. Interspersed with the plurality of thermal conduction structures 710 is an enhanced thermal transfer material 1000 including expanded graphite saturated with a phase change material. The enhanced thermal transfer material is in direct contact with the outer surface of the heat pipe 430 as well as the surfaces of the plurality of thermal conduction structures 710.

Figure 11:
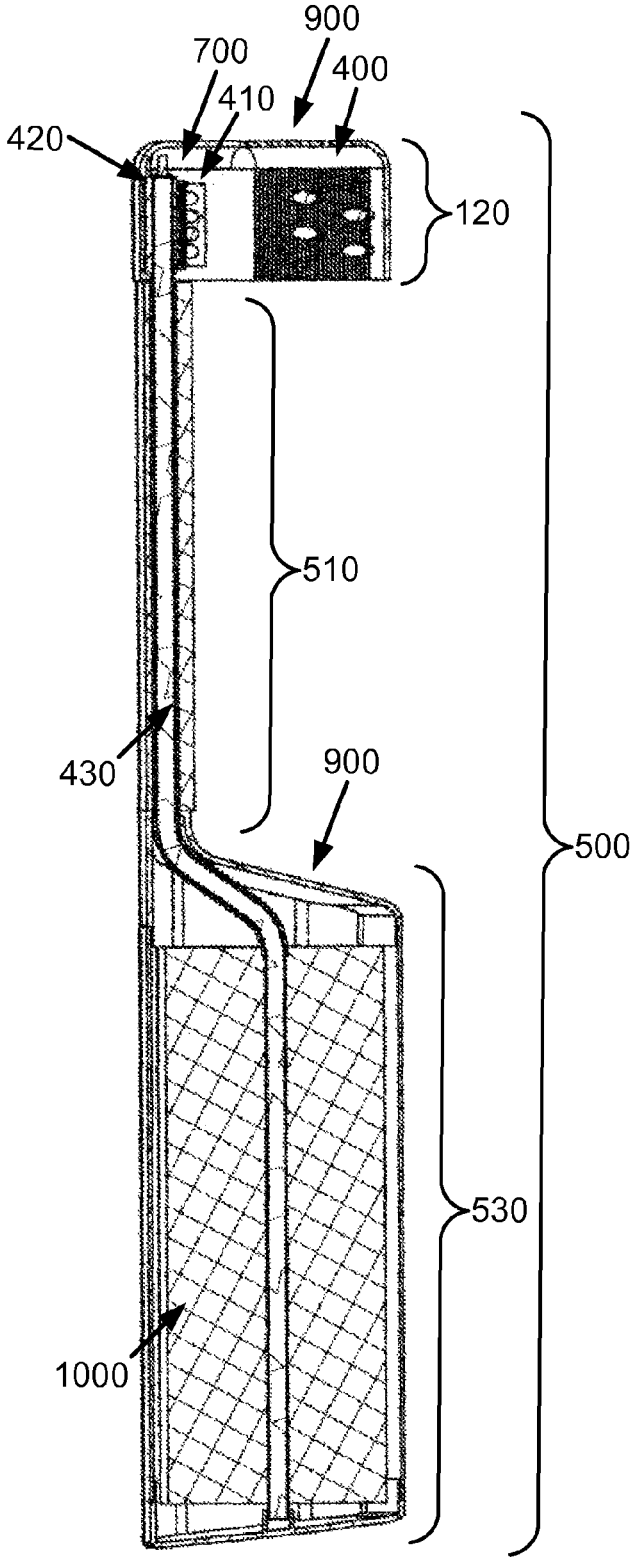
FIG. 11 is a substantially vertical cross-section view of a regulated thermal transfer device.

FIG. 11 illustrates part of an embodiment of a regulated thermal transfer device 500 as a substantially cross-section view. During use, the regulated thermal transfer device 500 is positioned within and attached to a temperature-stabilized storage container along with an attached circuitry unit (not shown in FIG. 11). The embodiment illustrated includes a cover 900 surrounding the exterior of the shown regulated thermal transfer device 500. The portion of a regulated thermal transfer device 500 shown in FIG. 11 includes a heat sink unit 120, an adiabatic region 510 and a phase change material unit 530. The heat sink unit 120 includes a heat transfer unit 420 in direct thermal contact with the top end of a heat pipe 430, and a thermal transfer unit 400 in thermal contact with the heat transfer unit 420 through a plurality of heat pipes 410 affixed to the heat transfer unit 420. A thermoelectric device 700 is thermally connected to the top end of the heat pipe 430, in direct contact with the heat transfer unit 420.

In the embodiment shown in FIG. 11, the phase change material unit 530 includes a cover 900 substantially defining the outer boundary of the phase change material unit 530. The lower end of the heat pipe 430 traverses the interior of the phase change material unit 530. In the embodiment shown in FIG. 11, the lower end of the heat pipe 430 traverses the interior of the phase change material unit 530 substantially through the center of the interior of the phase change material unit 530. Surrounding the region of the heat pipe 430 within the phase change material unit 530 is an enhanced thermal transfer material 1000 including expanded graphite saturated with a phase change material. The enhanced thermal transfer material 1000 is in direct contact with the outer surface of the heat pipe 430 throughout the length of the heat pipe 430 within the phase change material unit 530.

Figure 12:
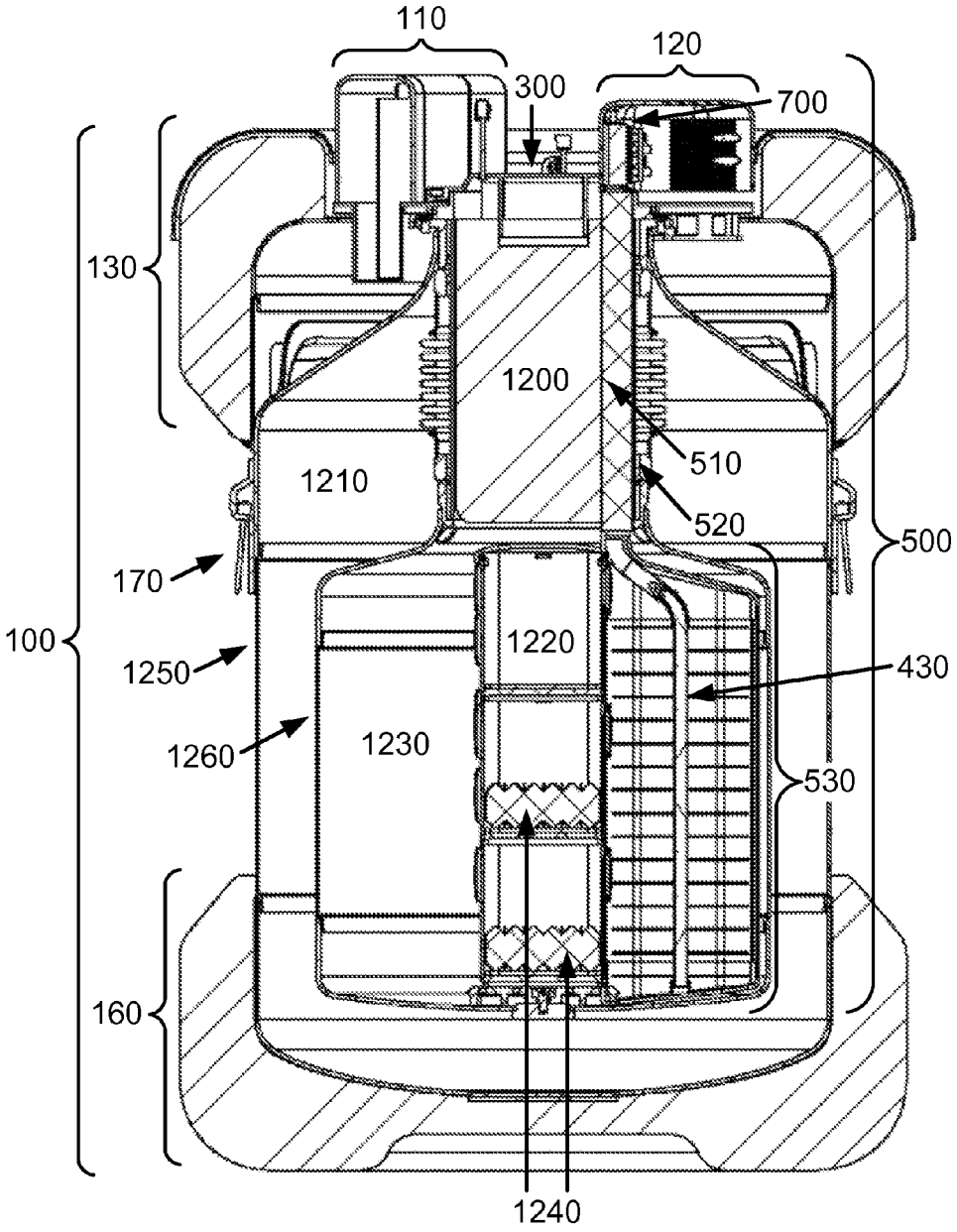
FIG. 12 is a substantially vertical cross-section view of a regulated thermal transfer device in position within a storage container.

FIG. 12 illustrates an embodiment of a regulated thermal transfer device 500 within a temperature-stabilized storage container 100 in a substantially cross-section view. The temperature-stabilized storage container 100 includes an outer wall 1250 substantially defining an outer surface of the storage container 100, the outer wall 1250 including an outer aperture in an upper region (e.g. adjacent to the lid 300). The temperature-stabilized storage container 100 includes an inner wall 1260 substantially defining a temperature-stabilized storage region 1230 internal to the storage container 100, the inner wall 1260 including an inner aperture in an upper region (e.g. adjacent to the junction with the internal conduit 1200). The temperature-stabilized storage container 100 includes a gap 1210 between the outer wall 1250 and the inner wall 1260, and a conduit 1200 connecting the outer aperture to the inner aperture. One or more sections of ultra-efficient insulation material are positioned within the gap 1210. The regulated thermal transfer device 500 within the temperature-stabilized storage container 100 includes a phase-change material unit 530 attached to an internal surface of the temperature-stabilized storage region 1230. The regulated thermal transfer device 500 within the temperature-stabilized storage container 100 includes a heat pipe 430 with a first end positioned within the phase-change material unit 530, and a second end positioned adjacent to the outer aperture. The regulated thermal transfer device 500 within the temperature-stabilized storage container 100 includes a thermoelectric unit 700 in contact with the second end of the heat pipe 430, and a heat sink unit 120 connected to the thermoelectric unit 700 and positioned to radiate heat away from the thermoelectric unit 700. The regulated thermal transfer device 500 also includes an electronic controller connected to the thermoelectric unit 700. In the illustrated embodiment, the electronic controller is positioned within the circuitry unit 110.

In some embodiments, a temperature-stabilized storage container includes wherein the conduit is substantially vertical when the temperature-stabilized storage container is positioned for use. For example, in the embodiment shown in FIG. 12, the conduit 1200 is substantially vertical, and generally maintains that position during use. The adiabatic region 510 of the regulated thermal transfer device 500 shown in FIG. 12 includes a surface 520 positioned to reversibly mate with the interior surface of the conduit 1200. The base 160 assists in maintaining the position of the entire temperature-stabilized storage container 100, including the internal conduit 1200. In some embodiments, the conduit is of a size and shape to permit insertion and removal of a medicinal vial package with minimal excess space. For example, in the embodiment shown in FIG. 12, a plurality of medicinal vials in associated packaging 1240 is poisoned within a storage unit 1220 that is of a size and shape to be inserted and removed from the temperature-stabilized storage region 1230 as needed by a user of the container 100. In some embodiments, a temperature-stabilized storage container includes wherein the conduit is a substantially tubular shape with a diameter between approximately 4 centimeters and approximately 6 centimeters. In some embodiments, a temperature-stabilized storage container includes wherein the conduit is a substantially tubular shape with a diameter between approximately 5 centimeters and approximately 7 centimeters. In some embodiments, a temperature-stabilized storage container includes wherein the conduit is a substantially tubular shape with a diameter between approximately 12 centimeters and approximately 13 centimeters. In some embodiments, a temperature-stabilized storage container includes wherein the conduit is a substantially tubular shape with a diameter between approximately 10 centimeters and approximately 15 centimeters.

In some embodiments, a temperature-stabilized storage container includes at least one section of ultra-efficient insulation material. In some embodiments, a temperature-stabilized storage container includes one or more sections of ultra-efficient insulation material substantially defining a temperature-stabilized storage container including a temperature-stabilized storage region with a single access aperture to the temperature-stabilized storage region. In the embodiment shown in FIG. 12, at least one section of ultra-efficient insulation material can be positioned within the gap 1210. For example, in some embodiments a temperature-stabilized storage container includes at least one section of ultra-efficient insulation material within the gap including: a plurality of layers of multilayer insulation substantially surrounding the thermally sealed storage region; and substantially evacuated space surrounding the plurality of layers of multilayer insulation. Some embodiments, for example, include substantially evacuated space that has a pressure less than or equal to $5\times10^{-4}$ torr. For example, in some embodiments a temperature-stabilized storage container includes at least one section of ultra-efficient insulation material within the gap including one or more sections of an aerogel. In some embodiments, a temperature-stabilized storage container includes a temperature-stabilized storage region that is configured to be maintained at a temperature substantially between approximately 2 degrees Centigrade and approximately 8 degrees Centigrade. In some embodiments, a temperature-stabilized storage container includes a temperature-stabilized storage region that is configured to be maintained at a temperature substantially between approximately 0 degrees Centigrade and approximately 10 degrees Centigrade. In some embodiments, a temperature-stabilized storage container includes a temperature-stabilized storage region that is configured to be maintained at a temperature substantially between approximately 3 degrees Centigrade and approximately 7 degrees Centigrade. For example, a temperature-stabilized storage region can be configured to be maintained within a temperature range based on operation of the regulated thermal transfer device attached to the container.

Figure 13:
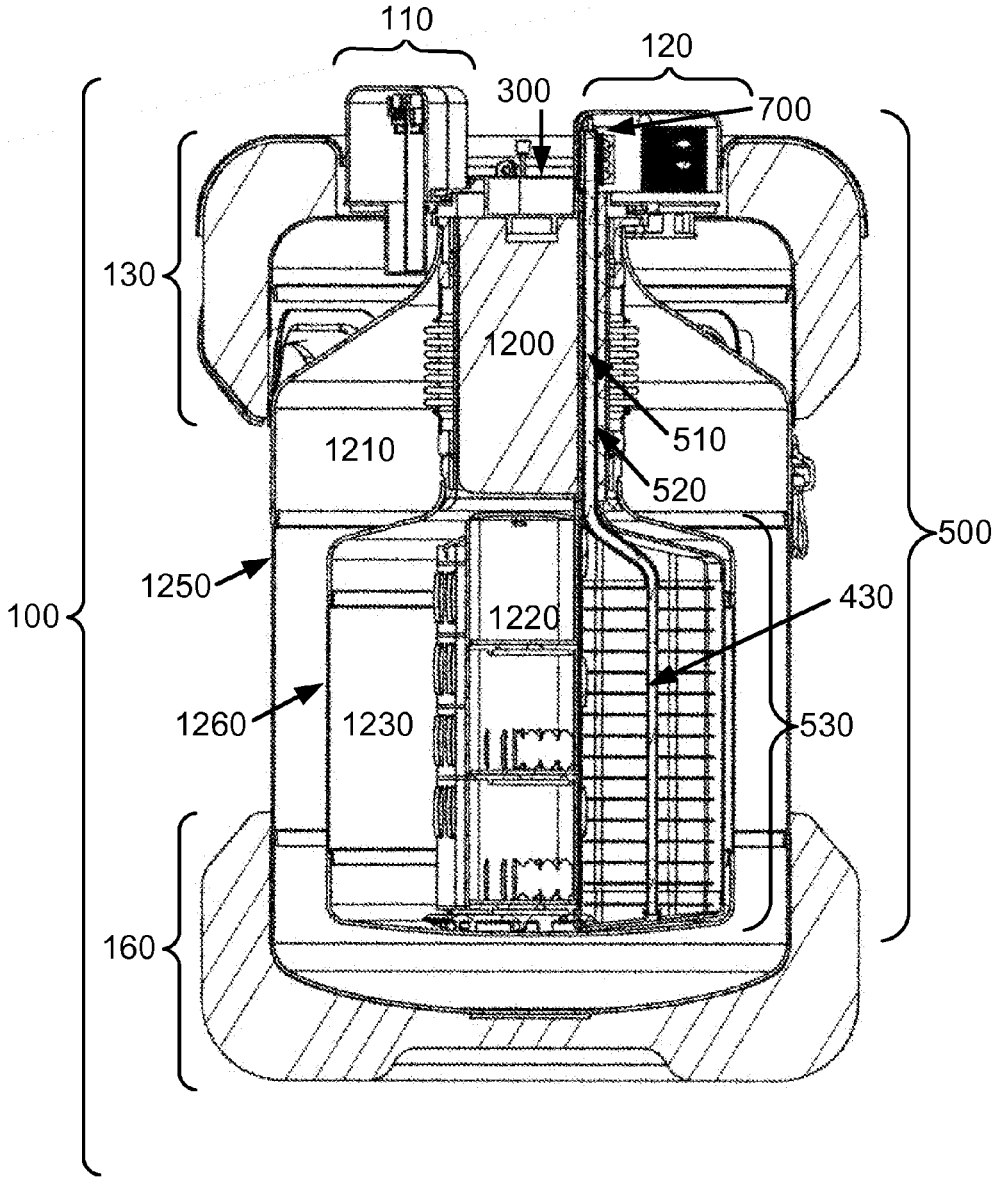
FIG. 13 is a substantially vertical cross-section view of a regulated thermal transfer device in position within a storage container.

FIG. 13 illustrates an embodiment of a regulated thermal transfer device 500 within a temperature-stabilized storage container 100 in a substantially cross-section view. The temperature-stabilized storage container 100 includes an outer wall 1250 substantially defining an outer surface of the storage container 100, the outer wall 1250 including an outer aperture in an upper region. The outer aperture is closed with a removable lid 300. The temperature-stabilized storage container 100 includes an inner wall 1260 substantially defining a temperature-stabilized storage region 1230 internal to the storage container 100, the inner wall 1260 including an inner aperture in an upper region. In the embodiment shown in FIG. 13, a storage unit 1220 including medicinal material in packaging 1240 is positioned adjacent to the inner aperture. The temperature-stabilized storage container 100 includes a gap 1210 between the outer wall 1250 and the inner wall 1260, and a conduit 1200 connecting the outer aperture to the inner aperture. One or more sections of ultra-efficient insulation material are positioned within the gap 1210. The regulated thermal transfer device 500 within the temperature-stabilized storage container 100 includes a phase-change material unit 530 attached to an internal surface of the temperature-stabilized storage region 1230. The regulated thermal transfer device 500 within the temperature-stabilized storage container 100 includes a heat pipe 430 with a first end positioned within the phase-change material unit 530, and a second end positioned adjacent to the outer aperture. The regulated thermal transfer device 500 within the temperature-stabilized storage container 100 includes a thermoelectric unit 700 in contact with the second end of the heat pipe 430, and a heat sink unit 120 connected to the thermoelectric unit 700 and positioned to radiate heat away from the thermoelectric unit 700. The regulated thermal transfer device 500 also includes an electronic controller connected to the thermoelectric unit 700. In the illustrated embodiment, the electronic controller is positioned within the circuitry unit 110.

Figure 14:
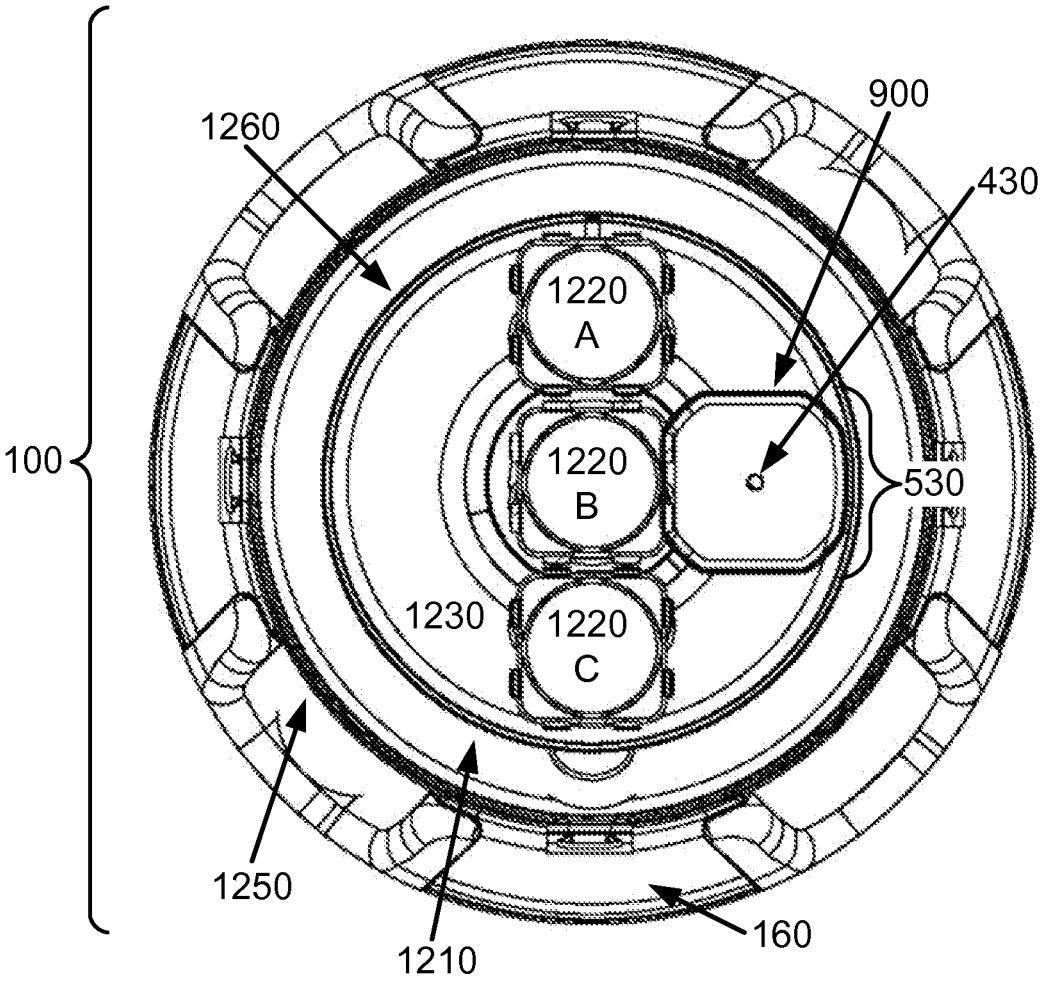
FIG. 14 is a substantially horizontal cross-section view of a regulated thermal transfer device in position within a storage container.

FIG. 14 illustrates a cross-section view substantially horizontally through a phase-change material unit 530 of a regulated thermal transfer device within a temperature-stabilized storage container 100. The temperature-stabilized storage container 100 includes an outer wall 1250 surrounded by a base 160. The temperature-stabilized storage container 100 includes an inner wall 1260 positioned within the outer wall 1250. A gap 1210 exists between the inner wall 1260 and the outer wall 1250. In some embodiments, at least one section of ultra-efficient insulation material is positioned within the gap 1210. The inner wall 1260 substantially defines a temperature-stabilized storage region 1230 within the container 100. A series of storage units 1220 A, 1220 B, 1220 C are positioned adjacent to each other within the temperature-stabilized storage region 1230. A phase-change material unit 530 of a regulated thermal transfer device is attached to the inner surface of the inner wall 1260. The phase-change material unit 530 is surrounded by a cover 900 and includes an interior heat pipe 430.

Figure 15:
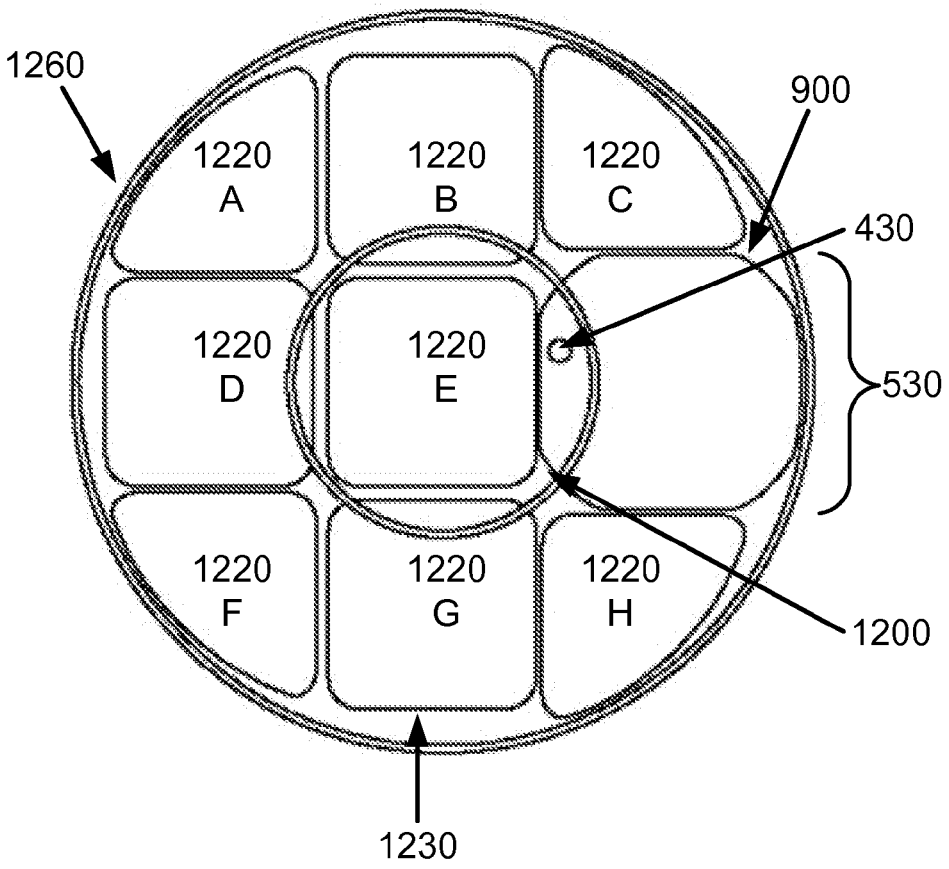
FIG. 15 is a schematic of a regulated thermal transfer device and storage units in position within a temperature-stabilized storage container.

FIG. 15 illustrates positioning of a plurality of storage units within a temperature-stabilized storage container including a regulated thermal transfer device. The plurality of storage units 1220 A, 1220 B, 1220 C, 1220 D, 1220 E, 1220 F, 1220 G and 1220 H are collectively referred to as "storage units 1220" with reference to the Figures herein. As shown in FIG. 15, the inner wall 1260 of a temperature-stabilized storage container including a regulated thermal transfer device substantially defines the perimeter of a temperature-stabilized storage region 1230. A phase-change material unit 530 of a regulated thermal transfer device is attached to the inner surface of the inner wall 1260. The phase-change material unit 530 includes an external cover 900. The phase-change material unit 530 includes a heat pipe 430 positioned within the interior of the phase-change material unit 530. As illustrated in FIG. 15, the storage units 1220 are shaped and positioned to substantially fill the interior space of the temperature-stabilized storage region 1230. As illustrated in FIG. 15, the storage units 1220 are not all shaped identically. All of the storage units 1220 are sized and shaped to individually fit through the conduit 1200, the diameter of which is shown in FIG. 15 for purposes of illustration.

In some embodiments, the circuitry unit includes one or more controllers and one or more memory units. As described above, the regulated thermal transfer device may control the temperature in the temperature-stabilized storage region by controlling operation of the one or more thermoelectric unit integral to the regulated thermal transfer device. A controller of the circuitry unit according to an embodiment can include at least one processor coupled to a power source (e.g., a photovoltaic panel) and to a power management unit. The controller can include a processor configured to direct a power management unit to provide power to the thermoelectric unit in response to input from a temperature sensor within the temperature-stabilized storage region of a temperature-stabilized storage container.

For instance, a thermoelectric unit may be connected at a power output connection to the circuitry unit. A controller within the circuitry unit may direct a power management unit to supply power to the power output connection and to the thermoelectric unit. As such, by controlling whether the thermoelectric unit operates or voltage provided to the thermoelectric unit, the controller can control the temperature in the temperature-stabilized storage region of a temperature-stabilized storage container. In other words, for example, the controller may direct the thermoelectric unit to remove heat from the phase change material unit until a predetermined portion of the phase change material is at a suitable temperature or is in a solid phase. Consequently, the controller can control the temperature in the storage compartment to within about ±1° C.

The controller and the power management unit also may adjust or transform the power received from the power source to a suitable voltage or, for example, may convert the power to direct current. For instance, as described above, the power source may include a photovoltaic panel. In some operating conditions, the output voltage from the photovoltaic panel may vary (e.g., due to variance in exposure to light). The controller and the power management unit may convert the power received from the photovoltaic panel to a suitable voltage, which may be further supplied to other elements or components of the regulated thermal transfer device, such as to the controller and to the thermoelectric unit, among others. In other words, the circuitry unit may be programmed to receive varying or variable voltage from the power source and to regulate such voltage to further provide suitable voltage to the heat pump.

In an embodiment, the power output connection may be coupled to a memory, which may contain operating instructions for the power output connection. Specifically, in an embodiment, the memory may include instructions about desirable temperature or temperature distribution in the phase change material unit. For example, the memory may include instructions that relate change in volume of the phase change material unit to a suitable temperature distribution therein.

For instance, the phase change material unit may include a whase change material that is water. As water changes phase from liquid to solid, the total volume of the water in the phase change material unit will change. Furthermore, the initial volume of the water (e.g., when all of the water is in a liquid phase) may be known or stored in the memory. Accordingly, the circuitry unit may receive information about the volume (e.g., from one or more sensors) of the phase change material unit and may calculate change in volume. Moreover, the processor may calculate the amount of solid phase change material. Hence, the instructions stored in the memory may allow the processor to determine the amount of solid phase PCM or temperature distribution in the phase change material unit.

In additional or alternative embodiments, the instructions stored in the memory also may allow the processor to use one or more temperature readings from the phase change material unit to control operation of the thermoelectric unit. For instance, the processor may receive a single or multiple temperature readings (e.g., from sensors) indicative of the temperature in one or more zones in the phase change material unit. When the temperature in the predetermined one or more zone in the phase change material unit is at a predetermined level, as set in the instructions in the memory, the processor may stop operation of the thermoelectric unit.

In any case, the memory may include instructions that may allow the processor to determine whether to direct power management unit to supply power to the thermoelectric unit connected at power output connection, thereby controlling the temperature in the phase change material unit and, thus, in the temperature-stabilized storage region of a temperature-stabilized storage container. For instance, the processor may maintain operation of the thermoelectric unit until reaching a predetermined temperature level (e.g., 3° C.).

The memory also may include instructions regarding priority or hierarchy of power needs. In other words, when the power received from the power source is insufficient to power all elements or components connected at the power output connection, the processor may use the priority instructions to direct the power management unit to provide power to elements or components indicated as having priority over other elements or components. For instance, the processor may give priority to providing power to the controller over the thermoelectric unit. In an embodiment, the priority hierarchy may be as follows, listed from highest to lowest: controller (or battery attached to the controller, if any); thermoelectric unit of the heat sink unit, fan for the heat sink unit (if any); display unit (if any).

The state of the art has progressed to the point where there is little distinction left between hardware, software (e.g., a high-level computer program serving as a hardware specification), and/or firmware implementations of aspects of systems; the use of hardware, software, and/or firmware is generally (but not always, in that in certain contexts the choice between hardware and software can become significant) a design choice representing cost vs. efficiency tradeoffs. There are various vehicles by which processes and/or systems and/or other technologies described herein can be effected (e.g., hardware, software (e.g., a high-level computer program serving as a hardware specification), and/or firmware), and that the preferred vehicle will vary with the context in which the processes and/or systems and/or other technologies are deployed. For example, if an implementer determines that speed and accuracy are paramount, the implementer may opt for a mainly hardware and/or firmware vehicle; alternatively, if flexibility is paramount, the implementer may opt for a mainly software (e.g., a high-level computer program serving as a hardware specification) implementation; or, yet again alternatively, the implementer may opt for some combination of hardware, software (e.g., a high-level computer program serving as a hardware specification), and/or firmware in one or more machines, compositions of matter, and articles of manufacture, limited to patentable subject matter under 35 U.S.C. §101. Hence, there are several possible vehicles by which the processes and/or devices and/or other technologies described herein may be effected, none of which is inherently superior to the other in that any vehicle to be utilized is a choice dependent upon the context in which the vehicle will be deployed and the specific concerns (e.g., speed, flexibility, or predictability) of the implementer, any of which may vary.

In some implementations described herein, logic and similar implementations may include computer programs or other control structures. Electronic circuitry, for example, may have one or more paths of electrical current constructed and arranged to implement various functions as described herein. In some implementations, one or more media may be configured to bear a device-detectable implementation when such media hold or transmit device detectable instructions operable to perform as described herein. In some variants, for example, implementations may include an update or modification of existing software (e.g., a high-level computer program serving as a hardware specification) or firmware, or of gate arrays or programmable hardware, such as by performing a reception of or a transmission of one or more instructions in relation to one or more operations described herein. Alternatively or additionally, in some variants, an implementation may include special-purpose hardware, software (e.g., a high-level computer program serving as a hardware specification), firmware components, and/or general-purpose components executing or otherwise invoking special-purpose components. Specifications or other implementations may be transmitted by one or more instances of tangible transmission media as described herein, optionally by packet transmission or otherwise by passing through distributed media at various times.

Alternatively or additionally, implementations may include executing a special-purpose instruction sequence or invoking circuitry for enabling, triggering, coordinating, requesting, or otherwise causing one or more occurrences of virtually any functional operation described herein. In some variants, operational or other logical descriptions herein may be expressed as source code and compiled or otherwise invoked as an executable instruction sequence. In some contexts, for example, implementations may be provided, in whole or in part, by source code, such as C++, or other code sequences. In other implementations, source or other code implementation, using commercially available and/or techniques in the art, may be compiled//implemented/translated/converted into a high-level descriptor language (e.g., initially implementing described technologies in C or C++ programming language and thereafter converting the programming language implementation into a logic-synthesizable language implementation, a hardware description language implementation, a hardware design simulation implementation, and/or other such similar mode(s) of expression). For example, some or all of a logical expression (e.g., computer programming language implementation) may be manifested as a Verilog-type hardware description (e.g., via Hardware Description Language (HDL) and/or Very High Speed Integrated Circuit Hardware Descriptor Language (VHDL)) or other circuitry model which may then be used to create a physical implementation having hardware (e.g., an Application Specific Integrated Circuit).

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood that each function and/or operation within such block diagrams, flowcharts, or examples can be implemented, individually and/or collectively, by a wide range of hardware, software (e.g., a high-level computer program serving as a hardware specification), firmware, or virtually any combination thereof, limited to patentable subject matter under 35 U.S.C. 101. In an embodiment, several portions of the subject matter described herein may be implemented via Application Specific Integrated Circuits (ASICs), Field Programmable Gate Arrays (FPGAs), digital signal processors (DSPs), or other integrated formats. However, some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, limited to patentable subject matter under 35 U.S.C. 101, and that designing the circuitry and/or writing the code for the software (e.g., a high-level computer program serving as a hardware specification) and or firmware would be well within the skill of one of skill in the art in light of this disclosure. The mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link (e.g., transmitter, receiver, transmission logic, reception logic, etc.), etc.).

In a general sense, the various aspects described herein which can be implemented, individually and/or collectively, by a wide range of hardware, software (e.g., a high-level computer program serving as a hardware specification), firmware, and/or any combination thereof can be viewed as being composed of various types of "electrical circuitry." Consequently, as used herein "electrical circuitry" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of memory (e.g., random access, flash, read only, etc.)), and/or electrical circuitry forming a communications device (e.g., a modem, communications switch, optical-electrical equipment, etc.). The subject matter described herein may be implemented in an analog or digital fashion or some combination thereof.

The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components, and/or wirelessly interactable, and/or wirelessly interacting components, and/or logically interacting, and/or logically interactable components.

In some instances, one or more components may be referred to herein as "configured to," "configured by," "configurable to," "operable/operative to," "adapted/adaptable," "able to," "conformable/conformed to," etc. Those skilled in the art will recognize that such terms (e.g. "configured to") generally encompass active-state components and/or inactive-state components and/or standby-state components, unless context requires otherwise.

The herein described components (e.g., operations), devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components (e.g., operations), devices, and objects should not be taken limiting.

All of the above U.S. patents, U.S. patent application publications, U.S. patent applications, foreign patents, foreign patent applications and non-patent publications referred to in this specification and/or listed in any Application Data Sheet, are incorporated herein by reference, to the extent not inconsistent herewith.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A regulated thermal transfer device for a storage container, comprising:

a phase change material unit, the phase change material unit including one or more walls surrounding a phase-change material region, and an aperture in the one or more walls;

a heat pipe with a first end positioned within the phase change material unit, and a second end traversing the aperture of the one or more walls of the phase change material unit;

a thermoelectric unit thermally connected to the second end of the heat pipe;

a heat sink connected to the thermoelectric unit, and positioned to radiate heat away from the thermoelectric unit; and an electronic controller operably connected to the thermoelectric unit;

wherein the regulated thermal transfer device is of a size and shape to be positioned so that the phase change material unit is within a storage region of a temperature-stabilized storage container, and the thermoelectric unit is positioned adjacent to an external surface of the temperature-stabilized storage container.

2. The regulated thermal transfer device of claim 1, wherein the phase change material unit comprises:

a sealed container including a hydrocarbon-based phase-change material within an expanded graphite structure.

3. The regulated thermal transfer device of claim 1, wherein the phase change material unit comprises:

an aperture surrounding the heat pipe, and a seal connecting the aperture to the heat pipe.

4. The regulated thermal transfer device of claim 1, wherein the phase change material unit comprises:

an attachment region positioned to attach the phase change material unit to a surface of the storage region of the temperature-stabilized storage container.

5. The regulated thermal transfer device of claim 1, wherein the phase change material unit comprises:

a phase change material substantially filling a sealed interior region of the phase change material unit, the phase change material having a freeze temperature between about 0° C. to about 2° C.

6. The regulated thermal transfer device of claim 1, wherein the heat pipe comprises:

a plurality of thermal conduction structures positioned within the phase-change material unit and configured to transfer heat from the phase change material to the heat pipe.

7. The regulated thermal transfer device of claim 1, wherein the thermoelectric unit comprises:

a Peltier device.

8. The regulated thermal transfer device of claim 1, wherein the heat sink connected to the thermoelectric unit comprises:

a passive heat sink device.

9. The regulated thermal transfer device of claim 1, wherein the heat sink connected to the thermoelectric unit comprises:

an active heat sink device, the active heat sink device operably coupled to the controller.

10. The regulated thermal transfer device of claim 1, wherein the electronic controller comprises:

circuitry configured to control the thermoelectric unit in response to signals received from at least one temperature sensor.

11. The regulated thermal transfer device of claim 1, further comprising:

a temperature sensor attached to the phase change material unit; and a connector between the temperature sensor and the electronic controller.

12. The regulated thermal transfer device of claim 1, further comprising:

a connector attached to the electronic controller, the connector configured to provide electricity to the regulated thermal transfer device from an external power source.

13. The regulated thermal transfer device of claim 1, further comprising:

a communications unit operably coupled to the electronic controller.

14. The regulated thermal transfer device of claim 1, further comprising:

a second phase change material unit including one or more walls surrounding a phase-change material region, and an aperture in the one or more walls;

a second heat pipe with a first end positioned within the second phase change material unit, and a second end thermally connected to the thermoelectric unit.

15. A temperature-stabilized storage container, comprising:

one or more sections of ultra-efficient insulation material substantially defining a temperature-stabilized storage container including a temperature-stabilized storage region with a single access aperture to the temperature-stabilized storage region;

a phase change material unit attached to an internal surface of the temperature-stabilized storage region;

a heat pipe with a first end positioned within the phase-change material unit, and a second end positioned adjacent to the single access aperture on an outer surface of the temperature-stabilized storage container;

a thermoelectric unit in contact with the second end of the heat pipe;

a heat sink connected to the thermoelectric unit and positioned to radiate heat away from the thermoelectric unit; and an electronic controller connected to the thermoelectric unit.

16. The temperature-stabilized storage container of claim 15, wherein the one or more sections of ultra-efficient insulation material comprise:

a plurality of layers of multilayer insulation substantially surrounding the temperature-stabilized storage region; and substantially evacuated space surrounding the plurality of layers of multilayer insulation.

17. The temperature-stabilized storage container of claim 16, wherein the substantially evacuated space has a pressure less than or equal to $5\times10^{-4}$ torr.

18. The temperature-stabilized storage container of claim 15, wherein the temperature-stabilized storage region is configured to be maintained at a temperature substantially between approximately 2 degrees Centigrade and approximately 8 degrees Centigrade.

19. The temperature-stabilized storage container of claim 15, wherein the phase change material unit comprises:

a sealed container including a hydrocarbon-based phase-change material within an expanded graphite structure.

20. The temperature-stabilized storage container of claim 15, wherein the phase change material unit comprises:

an aperture surrounding the heat pipe, and a seal connecting the aperture to the heat pipe.

21. The temperature-stabilized storage container of claim 15, wherein the phase change material unit comprises:

a phase change material substantially filling a sealed interior region of the phase change material unit, the phase change material having a freeze temperature between about 0° C. and 2° C.

22. The temperature-stabilized storage container of claim 15, wherein the thermoelectric unit comprises:

a Peltier device.

23. The temperature-stabilized storage container of claim 15, wherein the heat sink connected to the thermoelectric unit comprises:

a passive heat sink device.

24. The temperature-stabilized storage container of claim 15, wherein the heat sink connected to the thermoelectric unit comprises:

an active heat sink device, the active heat sink device operably coupled to the electronic controller.

25. The temperature-stabilized storage container of claim 15, wherein the electronic controller comprises:

circuitry configured to control the thermoelectric unit in response to signals received from at least one temperature sensor.

26. The temperature-stabilized storage container of claim 15, further comprising:

a temperature sensor positioned within the temperature-stabilized storage region; and a connector between the temperature sensor and the electronic controller.

27. The temperature-stabilized storage container of claim 15, further comprising:

a second phase change material unit positioned within the temperature-stabilized storage region;

a second heat pipe with a first end positioned within the second phase-change material unit, and a second end positioned adjacent to the single access aperture, wherein the thermoelectric unit is in contact with the second end of the second heat pipe.

28. A temperature-stabilized storage container, comprising:

an outer wall substantially defining an outer surface of a storage container, the outer wall including an outer aperture in an upper region;

an inner wall substantially defining a temperature-stabilized storage region internal to the storage container, the inner wall including an inner aperture in an upper region;

a gap between the outer wall and the inner wall;

a conduit connecting the outer aperture to the inner aperture;

one or more sections of ultra-efficient insulation material within the gap;

a phase-change material unit attached to an internal surface of the temperature-stabilized storage region;

a heat pipe with a first end positioned within the phase-change material unit, and a second end positioned adjacent to the outer aperture;

a thermoelectric unit in contact with the second end of the heat pipe;

a heat sink unit connected to the thermoelectric unit and positioned to radiate heat away from the thermoelectric unit; and an electronic controller connected to the thermoelectric unit.

29. The temperature-stabilized storage container of claim 28, wherein the at least one section of ultra-efficient insulation material within the gap comprises:

a plurality of layers of multilayer insulation substantially surrounding the thermally sealed storage region; and substantially evacuated space surrounding the plurality of layers of multilayer insulation.

30. The temperature-stabilized storage container of claim 29, wherein the substantially evacuated space has a pressure less than or equal to $5\times10^{-4}$ torr.

31. The temperature-stabilized storage container of claim 28, wherein the temperature-stabilized storage region is configured to be maintained at a temperature substantially between approximately 2 degrees Centigrade and approximately 8 degrees Centigrade.

32. The temperature-stabilized storage container of claim 28, wherein the phase-change material unit comprises:

a sealed container including a hydrocarbon-based phase-change material within an expanded graphite structure.

33. The temperature-stabilized storage container of claim 28, wherein the phase-change material unit comprises:

a phase change material substantially filling a sealed interior region of the phase change material unit, the phase change material having a freeze temperature between about 0° C. and 2° C.

34. The temperature-stabilized storage container of claim 28, wherein the thermoelectric unit comprises:

a Peltier device.

35. The temperature-stabilized storage container of claim 28, wherein the heat sink comprises:

a passive heat sink device.

36. The temperature-stabilized storage container of claim 28, wherein the heat sink comprises:

an active heat sink device, the active heat sink device operably coupled to the electronic controller.

37. The temperature-stabilized storage container of claim 28, wherein the electronic controller comprises:

circuitry configured to control the thermoelectric unit.

38. The temperature-stabilized storage container of claim 28, further comprising:

a temperature sensor positioned within the temperature-stabilized storage region; and a connector between the temperature sensor and the electronic controller.

39. The temperature-stabilized storage container of claim 28, further comprising:

a power unit attached to an external surface of the container, the power unit operably coupled to the electronic controller.

40. The temperature-stabilized storage container of claim 28, further comprising:

a connector attached to the electronic controller, the connector configured to provide electricity from an external power source.

41. The temperature-stabilized storage container of claim 28, further comprising:

a display unit affixed to an external surface of the container, the display unit operably coupled to the electronic controller.

42. The temperature-stabilized storage container of claim 28, further comprising:

a communications unit operably coupled to the electronic controller.

43. The temperature-stabilized storage container of claim 28, further comprising:

a second phase change material unit positioned within the temperature-stabilized storage region;

a second heat pipe with a first end positioned within the second phase-change material unit, and a second end positioned adjacent to the single access aperture, wherein the thermoelectric unit is in contact with the second end of the second heat pipe.

* * * * *